US011891821B2

(12) United States Patent
Kipp, Jr.

(10) Patent No.: US 11,891,821 B2
(45) Date of Patent: Feb. 6, 2024

(54) MINI-CONCRETE TROWEL ATTACHMENT ASSEMBLY

(71) Applicant: John H. Kipp, Jr., Capon Bridge, WV (US)

(72) Inventor: John H. Kipp, Jr., Capon Bridge, WV (US)

( * ) Notice: Subject to any disclaimer, the term of this patent is extended or adjusted under 35 U.S.C. 154(b) by 49 days.

(21) Appl. No.: 17/450,985

(22) Filed: Oct. 14, 2021

(65) Prior Publication Data

US 2023/0123674 A1 Apr. 20, 2023

(51) Int. Cl.
*E04F 21/24* (2006.01)
*E01C 19/44* (2006.01)

(52) U.S. Cl.
CPC ..... *E04F 21/248* (2013.01); *E01C 19/44* (2013.01)

(58) Field of Classification Search
CPC ..... E01C 19/22; E01C 19/44; E04F 21/245; E04F 21/247; E04F 21/248
USPC ..... 404/112
See application file for complete search history.

(56) References Cited

U.S. PATENT DOCUMENTS 2,103,311 A * 12/1937 Atkin ..... A47L 11/164 15/180
2,860,506 A 11/1958 Drummond
4,738,218 A * 4/1988 Toncelli ..... E04F 21/1652 118/411
5,221,156 A 1/1993 Martin
5,442,832 A 8/1995 Tonsager
5,467,497 A 11/1995 Greene et al.
5,480,257 A 1/1996 Allen
5,533,830 A 7/1996 Barichello
5,544,384 A 8/1996 Forselius et al.
5,658,809 A 8/1997 Allen
5,664,280 A 9/1997 Tonsager
5,699,580 A 12/1997 Silverstein
6,019,545 A 2/2000 Allen et al.
6,536,989 B2 * 3/2003 Rijkers ..... E04F 21/247 404/112
6,637,974 B1 10/2003 Glenn
7,104,725 B1 * 9/2006 Kipp ..... E04F 21/08 404/112
7,144,193 B1 12/2006 Bousfield
7,144,194 B2 12/2006 Kipp, Jr.
7,399,140 B2 7/2008 Barcenas
(Continued)

*Primary Examiner* — Gary S Hartmann
(74) *Attorney, Agent, or Firm* — George L. Walton; PARTS LLC

(57) ABSTRACT

A mini-trowel attachment assembly having a rotary disk with a plurality of screw holes disposed therein with a plurality of replacement blades secured therein by a plurality of screw members. The plurality of replacement blades include at least a pair of elongated slots that allows the replacement blades to be adjusted slightly inward of an annular peripheral edge of the rotary disk. A free-wheeling self-lubricating bearing assembly having a first non-rotary bearing and spacer ring member attached to the rotary disk and a second free-wheeling member attached to the first non-rotary bearing and spacer ring member that freely rotates when it engages wall structures and upstanding obstructions in concrete surfaces. Also, the elongated slots allows the plurality of replacement blades to be adjusted slightly inward of an annular peripheral edge of the free-wheeling self-lubricating bearing assembly.

26 Claims, 7 Drawing Sheets

(56) References Cited

U.S. PATENT DOCUMENTS

| | | | | |
|---|---|---|---|---|
| 8,240,949 | B2 * | 8/2012 | Weber | E01C 19/4893 404/96 |
| 2004/0018052 | A1 | 1/2004 | Dhont | |
| 2005/0238429 | A1 * | 10/2005 | Kipp | E04F 21/248 404/112 |

* cited by examiner

MINI-CONCRETE TROWEL ATTACHMENT ASSEMBLY

CROSS REFERENCE TO RELATED APPLICATION(S)

None

BACKGROUND OF THE INVENTION

1. Field of the Invention

The present invention relates generally to a new and useful improvement in replacement finishing blades secured to a rotary disk or stabilizer for finishing various types of viscous or plastic materials before hardening into a cured state. More particularly, the present invention relates to an attachment for an angle grinder or other power movers that relieves a user from the necessity of having to finish the surface of concrete, plaster, mortar, drywall compound, and similar viscous substances by hand. The new and improved replacement blades includes at least a pair of elongated screw slots that receives a screw therein to align with a plurality of securement holes in rotary disks of various selective sizes to perfectly position replacement blade non-planar edges along a circular or an annular peripheral edge of the various selective sized rotary disks and at and not beyond a circular or an annular peripheral edge of a free-wheeling or free rotational bearing guide ring assembly when co-operably attached thereto to smoothly finish surface areas, surface edges close to wall structures, and vertical stub obstructions within the surface areas. An annular front outer face portion of the free-wheeling or the free rotational bearing guide ring assembly when co-operably attached to the rotary disks of varied sizes can act as a guide to prevent damage to the wall structures, and the vertical stub obstructions, thus eliminating the need for any labor intensive hand finishing.

2. Description of the Related Art

It is well known in the art to utilize hand-held finishing devices that includes several spaced apart replacement blades made of spring-like or flexible material attached to rotating disks to finish concrete and other viscous or plastic material generally referred to as "troweling devices."

Note that the spring-like or flexible replacement finishing blades as referenced in prior U.S. Pat. No. 7,144,194 B2 teach a smoothing non-planar edge positioned along a circular or an annular peripheral edge of a rotary disk to provide sufficient flexibility to glide over a concrete and other viscous or plastic surface of the material being smoothed or finished without digging into and damaging the material surface. Also, the rotary disk and the plurality of replacement blades are able to finish right at wall structures and around electrical or plumbing stub obstructions within concrete and other viscous or plastic surfaces, while allowing for smooth finishing at the wall structures and around the electrical or plumbing stub obstructions, thus eliminating the need for any additional labor intensive hand finishing.

These troweling devices with the aforementioned replacement blades and rotary disks enables a worker to finish concrete and other viscous or plastic material in small, confined spaces, or in hard to reach edges, without resorting to hand trowels.

Some hand troweling devices have elongated slots cooperating with an adjustment member for adjusting blade angles for finishing walls and corners. Some of these slots are positioned directly in the blades and others having adjustable slots within bracket members attached to the blades with a cooperating adjustment member for adjusting the blades to define specific blade angles for finishing walls and corners.

Note that none of these troweling devices have replacement blades and rotary disks that teaches the new and useful improvement of the present invention, alone or in combination with one another and/or with other features found in the following and other non-cited prior art patents.

In light of the present invention, the best prior art patents that were found do not teach troweling devices with the following combined inventive features. The troweling devices of the present invention that is utilized for finishing concrete and other viscous or plastic surfaces include a plurality of selective replacement blades having a pair of elongated slots disposed on a raised flat rear attachment portion of the plurality of selective replacement blades for adjustably receiving a pair of screw members to attach and align the plurality of selective replacement blades with a plurality of securing or threaded holes in selective rotary disks of varied sizes. The pair of elongated slots allows the plurality of selective replacement finishing blades to be adjustably aligned along the circular or annular peripheral edge of the selective rotary disk of varied sizes for smoothly finishing concrete and other viscous or plastic surfaces, and the plurality of selective replacement finishing blades being adjustably aligned along and not beyond the circular or annular peripheral edge of the free-wheeling or free rotational bearing guide ring assembly when attached to the selective rotary disks of varied sizes to smoothly finish surface areas, surface edges close to wall structures, and vertical stub obstructions within the finish surface areas. An annular front outer face portion of the free-wheeling or free rotational bearing guide ring assembly when attached directly to the selective rotary disks of varied sizes can act as a guide to prevent damage to the wall structures, and the vertical stub obstructions, thus eliminating the need for any labor intensive hand finishing.

The closet prior art patents to the present invention that have replacement finishing blades that are connected directly to a finishing planar blade disk by screw threaded members are identified as follows:

U.S. Pat. No. 5,221,156 A teaches a concrete finishing machine having a rotary disk with a plurality of threaded holes therein for attaching a plurality of replacement blades thereto by screw members for finishing a concrete surface. The concrete machine will finish surfaces within approximately 3 mm. to vertical obstructions within a concrete surface while providing a plate means for guiding the machine and preventing damage to the vertical obstructions, thus eliminating the need for expensive time consuming hand finishing.

U.S. Pat. No. 7,144,194 B2 is the referenced patent by the current applicant (inventor) of the instant application that is hereby being improved. This patent teaches a surface finishing tool having a rotary disk with a plurality of securing holes disposed thereon. The finishing tool includes a plurality of flexible or spring-like replacement blades having a plurality of replacement blades securing holes that are releasably secured directly to the rotary disk plurality of securing holes by screw members to allow the plurality of replacement blades to perfectly align along the circular or annular peripheral edge of the rotary disk to perform a smooth and polishing action. These replacement blades are easily replaced with reduced labor maintenance.

Each of the replacement blades referenced in the aforementioned U.S. Pat. No. 7,144,194 B2 having a raised flat rear disk attachment portion with one or more securing holes therethrough for receiving the above mentioned screw members. An intermediate portion extends from the raised flat rear disk attachment portion, away from the rotary plane of the rotary disk. A surface contact portion extends from the intermediate portion, with the intermediate portion angularly disposed between the raised flat rear disk attachment portion and the surface contact portion.

The intermediate portion of each replacement blade is angled away from the raised flat rear disk attachment portion by about forty-five degrees (more or less), with the surface contact portion forming a slightly shallow angle with the intermediate portion. This results in an angle between the surface contact portion of each replacement blade and the raised flat rear disk attachment portion, and having between four and twelve degrees (more or less) when the replacement blades are installed upon the rotary disk, as shown in FIG. 7. Also, other angles may be formed as desired, but the shallow angle of the surface contact portion of each of the replacement blades with the underlying surface forms a working surface that (so long as the plane of the rotary disk is parallel to the underlying surface) results in a trailing edge of each replacement blade planing over the underlying surface to provide a smoothing and polishing action thereon.

Note that several prior art patents were found that teach trowel devices having elongated slots or channels for changing or adjusting pitch angles for smoothing out joint compound or viscous material at wall and ceiling corners.

Furthermore, the aforementioned teachings of the prior art patents are different from the improved teaching of the instant application. The improved teaching of the instant application includes at least a pair of elongated slots or channels disposed on a raised flat rear disk attachment portion of a plurality of replacement finishing blades for adjustably receiving a pair of screw members to attach and align each of the plurality of replacement finishing blades with a plurality of manufactured securing or screw holes disposed in a rotary disk or stabilizer. Therefore, the at least a pair of elongated slots will allow each of the plurality of replacement finishing blades to adjustably accommodate rotary disks or stabilizers of varied sizes. Also, if any of the plurality of manufactured securing or screw holes in the rotary disk are misaligned, the at least a pair of elongated slots or channels will allow the pair of screw members to adjustably align with any of the misaligned manufactured securing or screw holes within the rotary disk or stabilizer to secure each of the plurality of replacement finishing blades to the rotary disk or stabilizer. This eliminates a user from having to replace the rotary disk or stabilizer with the misaligned manufactured securing or screw holes with a new rotary disk or stabilizer.

Further, the adjustment of the plurality of replacement finishing blades relative to the elongated slots or channels will allow each of the plurality of replacement finishing blades to be selectively adjusted at the annular peripheral edge of the rotary disk or stabilizer without the aforementioned free-wheeling bearing guide ring assembly being attached thereto, or adjusted at and not beyond the annular peripheral edge of the free-wheeling bearing guide ring assembly when attached to the rotary disk or stabilizer to smoothly finish around stub obstructions disposed within a concrete finishing surface and smoothly finish at wall surfaces without any damage thereto, while eliminating any hand trowel labor.

The above mentioned adjustable hand trowel patents that teach elongated slots or channels for changing or adjusting pitch angles for walls or ceiling corners are identified as follows:

U.S. Pat. No. 5,442,832 A teaches an adjustable trowel with a pair of planar blades that are hinged together along their adjacent edges and their complementary tabs. Each planar blades includes an arcuate bracket member with an arcuate slot that overlaps one another. A handle having a bolt hole for receiving a bolt member through the overlapping arcuate slots for adjustably securing the planar blades together by a washer and wing nut. This allows the plane blades to be adjusted to spread joint compound at corners and placement of the trowel at ceiling and floor lines at a variety of selective smoothing angles.

U.S. Pat. No. 5,467,497 A teaches an adjustable drywall corner tool comprising a pair of work engaging blades normally disposed substantially at a ninety degree angle to one another. A hinge extends between mating edges of the blades. An angle changing structure is cooperatively associated with the pair of blades and designed for changing the angle between the two blades, so that the blades will fit in an inside corner of more and less than the ninety degree angle. A handle extends from the angle changing structure, so that a person can grip the handle to apply taping to the corner.

U.S. Pat. No. 5,544,830 A teaches a wall corner finishing tool (see FIG. 1) includes a pair of integral blades connected by a living hinge. A pair of arcuate arms each has one end hingeably connected to the back of blades, and an opening extending along its length. The arms extend toward each other and overlap. A handle is attached to the intersection of the arms by a screw extended through the openings and into one end of the handle. When the screw is loosened, the arms can be slid toward or away from each other to adjust the angle of the blades. When the blades are positioned at a desired angle, the screw can be tightened to hold the blades in position. The angle between the front or working surfaces of the blades can be adjusted between 20 to 340 degrees. The integral living hinge connecting the pair of blades provides a smooth working surface.

U.S. Pat. No. 5,664,280 A teaches an adjustable trowel to facilitate formation of a coved corner between two structural panels comprises a blade assembly having two laterally spaced trapezoidal-shaped, rigid wing segments integrally joined along parallel inside edges by an intermediate segment which is of rectangular shape and of reduced thickness compared to the rigid wing segments to allow flexure in the area occupied by the intermediate segment. Affixed to each of the rigid wing segments are handle mounting brackets that overlap one another and include an arcuate slot therein for receiving a handle mounting bolt therethrough. By tightening the bolt by a washer and wing nut the wings are held at a selected angle to one another and with the intermediate segment assuming a desired curvature.

U.S. Pat. No. 5,699,580 A teaches an adjustable hand trowel generally comprises identically shaped first and second blade members, respectively, connected to each other and to a handle member. The handle member is secured to the blade members, by a bolt and nut arrangement. Note that the first and second blade members are adjusted by slightly loosening the bolt and nut arrangement and adjusting the intersection angle a to the desired angle that is to the angle of the corner being worked on.

The best prior art patents that teaches free-wheeling guide ring members and adjustable clearance cage guide systems are identified as follows:

U.S. Pat. No. 5,221,156 A teaches a concrete finishing machine with a disk or plate with a plurality of finishing blades that is attached thereto by a plurality of screw members as shown in FIG. 4. Also, FIG. 6 shows a free-wheeling circular metal guard plate with an associated bearing disposed about a drive shaft and located above the disk or finishing plate with the free-wheeling and bearing action of the circular metal guard plate is supported in column 2, lines 44-68.

U.S. Pat. No. 5,480,257 A teaches a concrete riding trowel machine having an adjustable guard clearance system for accommodating obstructions. The adjustable clearance system is comprised of a separate movable arc of trowel guard cage ring coupled to the cage or trowel frame by a displaceable coupling. Buffer wheels are mounted to the cage of the trowel for contacting a wall, allowing movement of the trowel along the wall when the movable arc has been retracted. These buffer wheels are mounted on axles within housings. The axles are adjustable within slots, which are generally perpendicular to the direction of travel of the trowel. This adjustment allows the buffer wheels to be moved outwardly to contact the wall when the arc is retracted. This facilitates finishing along the base of the wall. In other words, the trowel can be held against the wall with the buffer wheels riding along the wall to ensure that the finishing blades will not strike the wall and be damaged.

U.S. Pat. No. 5,658,089 A teaches a concrete hand or riding trowel machine having an adjustable guard clearance system for accommodating obstructions. The clearance system allows a trowel to finish a slab surface immediately adjacent an obstacle such as a wall, column or curb. When used to finish the slab surface adjacent a wall, the present clearance system is adapted to maintain the trowel in a spaced apart relationship with the wall while allowing finishing of the slab surface immediately adjacent the wall (See FIGS. 6 through 9). The system is comprised of a movable wing of trowel guard cage ring coupled to the cage or trowel frame by a displaceable coupling. Preferably, the movable wing comprises an elongated flat arc. The flat arc extends from one cage ring end to another cage ring end, and comprises three flat strips, a front, central and rear strips. The front strip extends outwardly from the longitudinal axis of one of the cage ring ends at approximately twenty-five degrees. Further, the central strip joins at an obtuse angle, and it is parallel to the axis of travel of trowel. The rear strip joins the central strip oppositely to the front strip, and the rear strip extends from the central strip to the other one of the cage ring ends.

The movable wing may be disposed in either a deployed position, adjacent lower ring (See FIGS. 1-3, 6 and 8) or in a retracted position (See FIGS. 7 and 9). When deployed, the movable wing is aligned with the lower ring, and it extends between the caged ring ends. When the movable wing is retracted, an unguarded segment of the rotor blades' sweep is exposed. This unguarded segment may be deployed immediately adjacent an obstacle to facilitate finishing (See FIG. 7). During such finishing, a band slides along wall to protect segment. A buffering system prevents the band from catching on the wall, and it also protects the wall from chipping and discoloring. This patent is a CIP of U.S. Pat. No. 5,480,257 A, which is recited above.

U.S. Pat. No. 6,019,545 A teaches a walk-behind trowel machine. The trowel machine includes a plurality of spaced apart finishing blades with an outermost tip portions (See FIG. 2) of the finishing blades. This outermost tip circumscribe a circle whose diameter is slightly exceeded by the effective diameter of the rotatable guard. The guard is generally in the form of a truncated cone. It is mounted for possible rotation so that it may be displaced when contacting an obstacle. Preferably it is suspended by and captivated between by a suspension system (See FIG. 4) comprising a plurality of rollers (See FIG. 2).

When the guard is moved up against the obstacle (See FIG. 1), it can rotate relative to the trowel, and it will not mar the surface of walls or other obstacles it may touch. Thus, when the guard is pressed against the obstacle (See FIG. 1), causes the lower outer ring to make contact therewith, the guard can rotate, as each roller freely enables an upper inner ring to revolve. Thus, to an appreciable extent, forces that might otherwise destabilize the trowel or guard, and that might otherwise cause marring of the obstacle surface, are dissipated. In other words, it should be appreciated that the guard is annular in form (See FIG. 5), occupying the space between the upper inner and lower outer rings. Support and rotation points are established by the radially spaced apart rollers contacting the upper inner ring of the annulus (i.e., ring 54). As the guard support points are substantially spaced apart from the center of rotation (See FIG. 5) wobbling and destabilizing forces are resisted, and more reliable trowel action results. Normally, the guard does not rotate (i.e., it is not power driven). However, when the guard contacts an obstacle it rolls along smoothly, enabling the power trowel to get as close as possible to concrete surface regions immediately adjacent the obstacle. Therefore, the guard can rotate and roll along any wall, for example, and the forces that destabilize conventional trowels in response to an obstacle contact are dissipated.

U.S. Pat. No. 6,637,974 B1 teaches a concrete surface-finishing machine having a protective cover. The protective cover is a cage made up of a series of generally circular guard rails. The surface-finishing machine has a rotating portion, which is an array of radially oriented troweling blades that travels in a generally circular path within the protective cover. This protective cover has a generally circular shape that covers the rotating blade portions along its path of travel. The protective cover further includes a pair of guard assemblies. Each guard assembly is comprised of an arm having a first end and a second end that is pivotally connected to the protective cover. Now referring to FIGS. 1 through 4, each end of the arm is rotatably connected to a pair of rollers by an attachment assembly.

The combination of the arm and the rollers are preferably designed and dimensioned so that when a first roller contacts a second surface, the other roller is also brought into contact with the second surface. A line, outside the dimensions of the protective cover, is then formed between the point of contact of the first roller and the point of contact of the second roller. Further movement of the surface-finishing machine will proceed along a line defined by the points of contact of the pair of rollers. These rollers prevent the surface-finishing machine from coming into contact with the wall or secondary surface and direct the surface-finishing machine in a generally smooth path of travel parallel to the direction of the wall or secondary surface.

Also, these rollers prevent damage to the secondary surface, the surface being finished, and the surface-finishing machine itself. Note that the freedom of rotation of the rollers is increased by the inclusion of bearings either as a part of the pair of rollers or as a part of the attachment means. The inclusions of bearings may or may not be required or necessary depending upon the particular use in which the surface-finishing machine is involved.

U.S. Pat. No. 7,399,140 B1 teaches a corded power drill, but it is contemplated that the power trowel (20) can equally be used with a battery powered drill. The power trowel (20) is chucked into the drill the same as a drill bit would be chucked into a drill. The power trowel (20) includes a plurality of spaced apart trowel blades (80, 82, 84) disposed about a central hub (32) for smoothing out concrete. Further, the trowel blades are attached to a trowel supports (81, 83 and 85) where only support (81) is identified in this FIGS. 4-8. Referring to FIG. 3, the power trowel further includes outer bearing risers (61, 63 and 65) are shown protruding from an outer ring (40). These risers include the outer bushings, bearings or holes (62 and 64) for the trowel (20) to pivot within. The inner bearing, bushings, or holes (70, 72 and 74) are shown as broken lines in FIG. 3, where they secure the inner ends of the trowel (20) and trowel supports (81, 83 and 85).

The combination trowel and trowel support are pivotably secured to the power trowel with bushings, with outer bearings or pivot points (60). Inner bearings are not shown in FIG. 3, but the combination of outer and inner bearings support the trowel blades (80, 82, 84) and allow them to pivot. The pivoting mechanism is shown and described in more detail with FIGS. 4 to 7 herein. The outer bearings, bushings exist in an outer bearing riser (61) that is welded to the outer ring or safety ring (40) that extends around the trowels to reduce the potential for harm, damage or injury from the rotating trowel blades (80, 82, 84).

A top cover (100) is shown that wraps over the sides of the blades (80, 82, 84). The cover (100) is connected to the central hub 32 with a bearing. The bearing allows the cover to spin independently from the troweling blades (80, 82, 84). This is partially useful to prevent the blades from scraping a wall or the leg of a user. When the top cover (100) comes in contact with a surface the cover stops spinning and guards the blades (80, 82, 84) from extending beyond the top cover (100). The cover (100) is designed to terminate slightly above the bottom of the blades 80 to prevent from marking the toweled surface.

In operation when the cover makes contact with a surface outside of the troweling blades (80, 82, 84) the cover (100) stops moving while the blades (80, 82, 84) continue to spin under the cover. Damage to the surface is prevented. The cover protects walls, and the user from accidentally coming in contact with the blades (80, 82, 84). The top cover has vents (102) that allow excess material to be pushed through the vents to prevent a build-up of material between the blades (80, 82, 84), safety ring (40) and the top cover (100). The ring provides a bearing surface and keeps the cover centered on the hub (32).

U.S. Pat. No. 8,075,222 B2 teaches a concrete finishing apparatus for smoothing and leveling partially set-up concrete at a support surface includes a frame portion, a first concrete working member and a second concrete working member disposed at the frame portion. The first concrete working member is rotatable about a first axis of rotation that is generally vertical when the first concrete working member is supported at a generally horizontal support surface. The second concrete working member is rotatable about a second axis of rotation that is generally vertical when the second concrete working member is supported at a generally horizontal support surface. The first and second concrete working members engage the partially set-up concrete surface at the support surface and rotate about the first and second axes of rotation to process the concrete surface.

Further, the following U.S. Pat. Nos. 3,973,857 A, 4,046,483 A, 5,533,830 A, 6,264,397 B1, 7,104,725 B1, 7,207,745 B2, 7,604,434 B2, 7,891,906 B2, 8757,925 B2, and 2004/0018052 A1 are hereby cited to show other prior art concrete trowel finishing devices of interest.

Note that none of the above mentioned prior patents teaches the unique present invention singly or in any combination thereof, which will be discussed in greater detail in the "Summary of the Invention", recited below.

SUMMARY OF THE INVENTION

It is an object of the present invention to have a plurality of replacement finishing blades as referenced in the aforementioned U.S. Pat. No. 7,144,194 B2 having a raised flat rear disk attachment portion with one or more securing holes therethrough for receiving the above mentioned screw members. An intermediate portion extends between the raised flat rear disk attachment portion and a front surface contact portion, away from the rotary plane of the rotary disk or stabilizer. The intermediate portion angularly disposed between the raised flat rear disk attachment portion and the front surface contact portion. The intermediate portion of each replacement finishing blade is angled away from the raised flat rear disk attachment portion to the surface contact portion by about forty-five degrees (more or less).

This results in a shallow angle between the front surface contact portion of each of the plurality of the replacement finishing blades and the raised flat rear disk attachment portions of each, and having between four and twelve degrees (more or less) when each of the plurality of the replacement finishing blades are installed upon the rotary disk or stabilizer, as shown in FIG. 7 of U.S. Pat. No. 7,144,194 B2. Other angles may be formed as desired, but the shallow angle of the front surface contact portion of each of the replacement finishing blades with the underlying surface being worked (so long as the plane of the rotary finishing disk or stabilizer is parallel to the underlying surface) results in the trailing edge of each replacement finishing blades planing over the underlying surface to provide a smoothing and polishing action thereon.

It is another object of the present invention to provide each of the plurality of replacement finishing blades having a pair of elongated slots disposed on the raised flat rear disk attachment portion of each of the plurality of replacement finishing blades for adjustably receiving a pair of screw members to attach and align each of the plurality of replacement finishing blades with a plurality of securing or threaded holes in the rotary disk or stabilizer. The pair of elongated slots will allow each of the plurality of replacement finishing blades to be adjusted proximate an annular peripheral edge of rotary disks or stabilizers of varied sizes to smoothly finish concrete surfaces or other viscous material surfaces, as well, as finishing smoothly around vertical stub obstructions within concrete surfaces or other viscous material surfaces. Note that each of the plurality of replacement finishing blades and the rotary disk or stabilizer may be constructed from diverse types of plastics and metals, if desired. Preferably, each of the plurality of replacement finishing blades are made from spring-like metal material that is able to flex and float over a viscous surface, such as concrete for smoothing out and finishing the concrete surface.

Further, the elongated slots will allow the plurality of replacement finishing blades to adjust and align perfectly with any misaligned manufactured securing, or threaded screw holes within a rotary finishing disk or stabilizer with a plurality of screw members. This eliminates a user from having to replace the rotary finishing disk or stabilizer in order to accommodate the plurality of replacement finishing blades.

Another object of the present invention provides each of the plurality of screw members with a selective fine pitch thread. The plurality of selective fine thread screw members extend through the rotary disk or stabilizer at a selective distance at a top portion thereof that will prevent debris, concrete, and other viscous or plastic material from penetrating into the plurality of threaded screw holes of the rotary disk or stabilizer and preventing damage to the selective fine pitch threads that can cause loosening and wobbling of each of the plurality of replacement finishing blades relative to the rotary disk or stabilizer.

A further object of the present invention provides a free-wheeling bearing guide ring assembly that is attached directly to and extend slightly beyond the outer periphery of a rotary finishing disk or stabilizer. This allows the replacement finishing blades to be selectively adjusted at and not beyond the peripheral edge of the free-wheeling bearing guide ring assembly via the aforementioned elongated slots or channels of the replacement blades to smoothly finish concrete or viscous surfaces around obstructions and along wall surfaces.

The free-wheeling bearing guide ring assembly of the present invention includes a first member attached inward of and directly around and adjacent the annular peripheral edge of the rotary disk or stabilizer. The first member is a non-rotating ring including a first portion having a plurality of spaced apart non-rotating arm members and a second portion having a plurality of connector screw tabs with screw securing holes disposed therein. Also, the plurality of spaced apart non-rotating arm members are integrally connected to the plurality of connector screw tabs at a bent section and extending angularly up therefrom with an integral forward end attached perpendicular to an intermediate rear inner face surface of each of the plurality of spaced apart non-rotating ring members. Each of the plurality of spaced apart non-rotating arm members further includes upper and lower radial extending clip fastening members with an outward forward end having a tapered or bevel portion. A plurality of screw members being inserted via the screw securing holes of each of the plurality of connector screw tabs to securely attach each of the plurality of non-rotating ring arm members to and inward of the annular peripheral edge of the rotary disk or stabilizer. Further, the angle of each of the plurality of spaced apart non-rotating arm members creates a clearance space between the lower radial extending clip fastening member and the top of the rotary disk or stabilizer.

A front outer face surface of each of the plurality of spaced apart non-rotating arm members having a self-lubricating bearing rail and spacer member disposed along an intermediate portion thereof, and opposite the integral forward end of each of the plurality of spaced apart non-rotating arm members that are attached to the intermediate portion of the rear inner face surface of each of the plurality of spaced apart non-rotating arm members.

Another object of the free-wheeling bearing guide ring assembly of the present invention includes a second member as an annular free-rotating or free-wheeling bearing cover guide ring member having a front outer face surface and a rear inner face surface. The rear inner face surface engages and encloses the front outer face surface of each of the plurality and spaced apart non-rotating arm members and each of the bearing rail and spacer members disposed thereon when the second member is co-operably secured to the upper and lower radial extending clip fastening members of the first member, each of the plurality and spaced apart non-rotating arm members by upper and lower clip fastening members of the annular free-rotating or free-wheeling bearing cover guide ring member. The upper and lower clip fastening members of the annular free-rotating or free-wheeling bearing cover guide ring member being attached to and radially extending from the annular free-rotating or free-wheeling bearing cover guide ring member at top and bottom portions thereof with an outward end having an outer tapered or bevel portion, and a lower portion integrally attached to the outer tapered or bevel portion with a radially extending outward end having a latching fastener, such as a bead member. The outward end of the annular free-rotating or free-wheeling bearing cover guide ring member having an inner tapered or bevel portion that aligns with and spaced from the outer tapered or bevel portion of the upper and lower radial extending clip fastening members of the first member at the top and bottom portions thereof, and creating a clearance space or gap therebetween that prevents the annular free-rotating or free-wheeling bearing cover guide ring member from hitting the top of the rotary disk or stabilizer during a concrete or viscous material finishing and smoothing operation.

A first fastening feature includes a fastening surface disposed below the top radial portion and above the bottom radial portion of the upper and lower radial extending clip fastening members of the first member. When the second member, the annular free-rotating or free-wheeling bearing cover guide ring member, is completely attached to the first member, the plurality of spaced apart non-rotating arm members, upon the upper and lower clip fastening members of the annular free-rotating or free-wheeling bearing cover guide ring member being received over the outer tapered or bevel portion of the top and bottom portions of the upper and lower radial extending clip fastening members of the first member with the fastening bead member abutting against and moving along the fastening surface that is disposed below the top radial portion and above the bottom radial portion of the upper and lower radial extending clip fastening members of the first member.

The above fastening arrangement causes the rear inner face surface of the annular free-rotating or free-wheeling bearing cover guide ring member to engage and move along each of the self-lubricating bearing rail and spacer members of each of the plurality of spaced apart non-rotating arm members when a prime mover rotates the rotary disk or stabilizer with the plurality of replacement finishing blades for smoothly finishing a concrete or viscous material surface. Once the rear inner face surface of the annular free-rotating or free-wheeling bearing cover guide ring member engages each of the self-lubricating bearing rail and spacer members of each of the plurality of spaced apart non rotating arm members, wherein the clearance space disposed between the inner tapered or bevel portions of the upper and lower clip fastening members of the annular free-rotating or free-wheeling bearing cover guide ring member of the second member and spaced from the outer tapered or bevel portion of the upper and lower radial extending clip fastening members of the first member at the top and bottom portions allows for free rotation of the annular free-rotating or free-wheeling bearing cover guide ring member.

Note that the aforementioned clearance space allows the annular free-rotating or free-wheeling bearing cover guide ring member of the second member to rotate along each of the self-lubricating bearing rail and spacer members of each the plurality of spaced apart non-rotating arm members without binding as the fastening bead member moves either optionally along the fastening surface or within each of the fastening cavities disposed below the top radial portion and above the bottom radial portion of the upper and lower radial extending clip fastening members of the first member that includes each one of the plurality of spaced apart non-rotating arm members when the annular free-rotating or free-wheeling bearing cover guide ring member rotates along each of the self-lubricating bearing rail and spacer members of each of the plurality of spaced apart non-rotating arm members.

According to another object of the present invention, the second member, the free-wheeling bearing guide ring assembly of the present invention includes at least a pair of separate semi-circular free-wheeling bearing cover guide ring members that abuts one another to form a single annular free-wheeling bearing cover guide ring member when fastened to the upper and lower radial extending clip fastening members of each of the plurality of spaced apart non-rotating arm members. Each of the at least a pair of separate semi-circular free-wheeling bearing cover guide ring members has a rear inner face surface, and a front outer face surface.

Also, each of the at least a pair of separate free-wheeling bearing cover guide ring members being attached to a first portion of the plurality of spaced apart non-rotating arm members extending angularly up from an integral bent section having a forward end integrally attached to a rear inner face surface of each of the separate semi-circular free-wheeling bearing cover guide ring members and a rear end integrally attached to each of the plurality of spaced apart non-rotating arm members having a second portion including a plurality of connector screw tabs that extends from the integral bent section in the same manner as previously discussed above, and the plurality of connector screw tabs having screw securing holes disposed therein. Further, a plurality of screw members being inserted via the screw securing holes of each of the plurality of connector screw tabs of each of the plurality of spaced apart non-rotating arm members to securely attach each of the plurality of connector tabs to and inward of the annular peripheral edge of the rotary disk or stabilizer in the same manner as previously discussed above.

Each of the at least a pair of separate semi-circular free-wheeling bearing cover guide ring members having a semi-circular upper and lower radial extending clip fastening members with an outward forward end having a tapered or bevel portion and top and bottom radial portions thereof. As previously discussed above, optionally, either a fastening surface or cavity is disposed below the top radial portion and above the bottom radial portion of each of the upper and lower radial extending clip fastening members of each of the plurality of spaced apart non-rotating arm members as shown in different embodiments of the present invention. The front outer face surface of each of the plurality of spaced apart non-rotating arm members includes a self-lubricating bearing rail and spacer member disposed along an intermediate portion thereof, and opposite the forward end of each of the plurality of spaced apart non-rotating arm members that is attached to an intersecting intermediate location of the rear inner face surface of each of the plurality of spaced apart non-rotating arm members.

Note that the second member that includes the at least a pair of separate semi-circular free-wheeling bearing cover guide ring members including a pair of ends, upon the pair of ends abutting one another that forms the single annular free-wheeling bearing cover guide ring member utilizes the upper and lower fastening clip members thereon for fastening to each of the upper and lower clip fastening members of the plurality of spaced apart non-rotating arm members.

A further feature of the present invention is to provide each of the self-lubricating bearing rail and spacer members of each of the plurality of spaced apart non-rotating arm members with a plurality of self-lubricating ball bearings disposed therein.

In a first bearing illustration, each of the self-lubricating bearing rail and spacer member of each of the plurality of spaced apart non-rotating arm members having an outward extending self-lubricating member being disposed along an intermediate portion on an outer front surface between a top surface and a bottom surface thereof. Also, in a second bearing illustration, each of the outward extending self-lubricating member of each of the self-lubricating bearing rail and spacer members of each of the plurality of spaced apart non-rotating arm members being disposed along the intermediate portion on the outer front surface thereof includes channel or cavity disposed therein, Note that each of the channels or cavities of the second bearing illustration, and each of the plurality of spaced apart holes or cavities in the third bearing illustration receives a plurality of spaced apart ball bearings disposed therein with a portion of the ball bearings extending partially outward thereof and partially inward of each of the channels or cavities. The plurality of spaced apart ball bearings can be selected from a group consisting of a plurality of bearing races with a plurality of spaced apart ball bearings disposed therein or having a plurality of separate and spaced apart ball bearings. Note that the plurality of bearing races and the plurality of separate and spaced apart ball bearings can be loosely snap fitted within each of the above described channels or cavities, and the spaced apart holes or cavities for non-binding movement therein.

Further, in a third bearing illustration, the front surface of each of the self-lubricating bearing rail and spacer members of each of the plurality of spaced apart non-rotating arm members includes the outward extending self-lubricating member disposed along the intermediate portion on the outer front surface thereof, the intermediate portion on the outer front surface and the includes a plurality of separate and spaced apart holes or cavities disposed therein for receiving a ball bearing member therein with a portion of the ball bearings extending partially outward thereof and partially inward of each of the plurality of separate and spaced apart holes or cavities. The ball bearing members being loosely snap fitted within each of the plurality of separate and spaced apart holes or cavities for easy non-binding movement therein.

Finally, a fourth bearing illustration, shows that the rear inner face surface of the second member, the annular free-rotating or free-wheeling bearing cover guide ring member, includes an annular channel disposed thereon for receiving the different ball bearing arrangements as previously discussed above when the second member is fastened to the upper and lower radial extending clip fastening members of the first member by the upper and lower clip fastening members of the annular free-rotating or free-wheeling bearing cover guide ring member. This fastening arrangement causes the annular channel within the rear inner face surface of the free-rotating or free-wheeling bearing cover guide ring member to engage and move along the different ball bearing arrangements when a prime mover rotates the rotary disk or stabilizer with the replacement finishing blades attached thereto for smoothly finishing a concrete or viscous material surface.

Note that the first member that includes the non-rotating ring, the plurality of spaced apart non-rotating arm members, and the second member, the annular free-rotating or free-wheeling bearing cover guide ring member, and the at least a pair of separate semi-circular free-rotating or free-wheeling bearing cover guide members are preferably made from self-lubricating plastics, such as Teflon. Other self-lubricating material may be selected from other plastics such as Delrin, a non-metal, such as, carbon graphite, metals fabricated with various self-lubricating coatings, one such as molybdenum disulphide (MoS2) with PTFE could be used, if desired.

This self-lubricating plastic, such as Teflon will allow the annular free-rotating or free-wheeling bearing cover guide ring member, and the at least a pair of separate semi-circular free-rotating or free-wheeling bearing cover guide ring members to rotate without binding relative to each of the plurality and spaced apart non-rotating arm members, the annular free-wheeling bearing cover guide ring member, and the at least a pair of separate semi-circular free-rotating or free-wheeling bearing cover guide ring members will rotate in one direction when it engages a wall structure or a stub obstruction and will rotate in an opposite direction when it moves away from the wall structure or the stub obstruction during a viscous material finishing operation. Also, this annular free-wheeling bearing cover guide ring member, and the at least a pair of separate semi-circular free-rotating or free-wheeling bearing cover guide ring members are structured is designed to overcome and destabilize forces that can cause vibration and wobbling of a mini-powered trowel device as the annular free-wheeling bearing cover guide ring member, and the at least a pair of separate semi-circular free-rotating or free-wheeling bearing cover guide ring members engages a wall structure, and any upstanding stub obstructions, such as, electrical and plumbing stubs, while preventing damage or marking thereto.

It is to be understood that the rotary disk or stabilizer for attaching the plurality of replacement finishing blades thereto is not limited to a rotary stabilizer or disk. The rotary disk or stabilizer can be selected from other types of attachment members for securing the plurality of replacement finishing blades thereto, such as, a spider member, a plurality of bar members, or a plurality of radial extending arm members, if desired. Note that the spider member, a plurality of bar members, or a plurality of radial extending arm members have open spaces there between. However, the rotary disk or stabilizer of the present invention is the selected and preferred stabilizer member for the plurality of replacement blades because of the following benefits. The benefits of the preferred rotary finishing stabilizer or disk over the other types of stabilizer attachment members are 1) provides no open spaces that would allow concrete or other viscous type material to fly upward there through towards a user, and 2) the non-open spaces of the rotary disk or stabilizer eliminates a user's clothing, long hair, or other items from being entangled with the plurality of replacement finishing blades to prevent major injuries to a user.

Additional aspects, objectives, features and advantages of the present invention will become better understood with regard to the following description and the appended claims of the preferred embodiments with reference to the accompanying drawings.

BRIEF DESCRIPTION OF THE DRAWINGS

The present invention may be better understood, along with its numerous objects, features, and advantages made apparent to those skilled in the art by referencing the accompanying drawings.

FIG. 5 illustrates a cut sectional side view of a free-wheeling or free-rotating bearing guide ring assembly having a plurality of spaced apart non-rotating arm members having a plurality of connector screw tabs secured to a rotary surface finishing stabilizer or disk and an annular free-rotating or free-wheeling bearing cover guide ring member fastened thereto and movable along a bearing rail and spacer member of a first embodiment according to the present invention.

DETAILED DESCRIPTION

The present invention defines a surface finishing tool with a rotary stabilizer or disk with a plurality of replacement finishing blades having a pair of elongated slots for adjusting the plurality of replacement finishing blades near an annular peripheral edge of the rotary stabilizer or disk and near an annular peripheral edge of a free-wheeling or free-rotating bearing guide ring assembly when attached to the rotary stabilizer or disk, which will be discussed in greater detail below.

Figure 1:
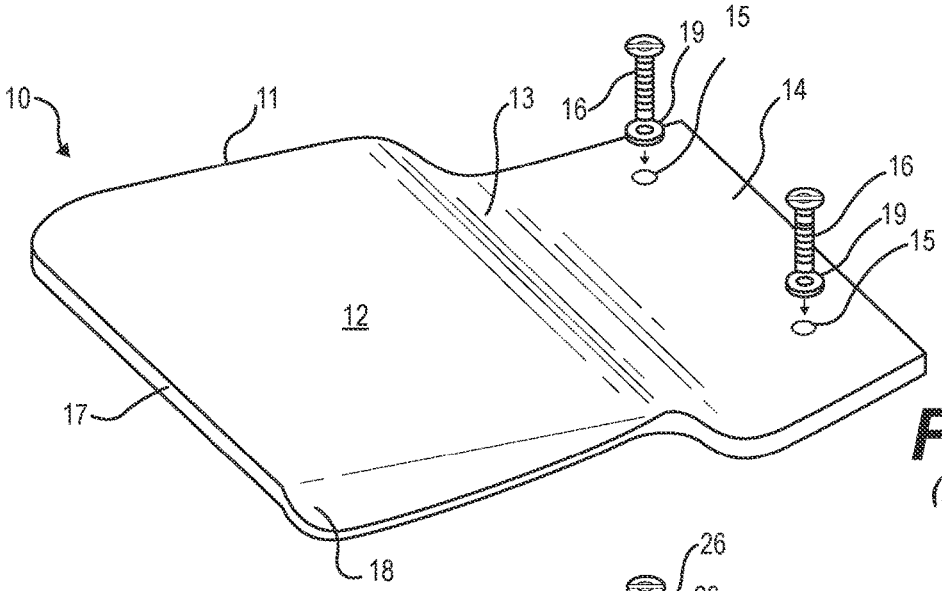
FIG. 1 (Prior Art)
FIG. 1 illustrates a perspective view of a prior art replacement finishing blade having a pair of round or circular screw securing holes disposed in a raised flat rear attachment portion thereof.

As shown in FIG. 1, a prior art surface finishing replacement blade unit being designated as 10 includes a replacement blade member 11 having a surface contact portion 12, an intermediate angular portion 13 that extends from the surface contact portion 12, and an attachment portion 15 that is integrally connected and extends angularly away from the intermediate portion 13. The attachment portion 14 includes a pair of attachment screw holes 15 disposed therein with a pair of screw members 16 and a pair of washers 19. Also, the replacement blade 11 further includes a trailing edge 17, and an outer bent edge 18. Attention is directed to FIG. 6, columns 5-8 of U.S. Pat. No. 7,144,194 B2 for details of the prior art surface finishing replacement blade 10. Note that the details of columns 5-8 of U.S. Pat. No. 7,144,194 B2 applies to the same elements of this application, except for the elongated screw slots and the free-wheeling or free-rotating guide ring assembly, which will be discussed in greater details below.

Figure 2:
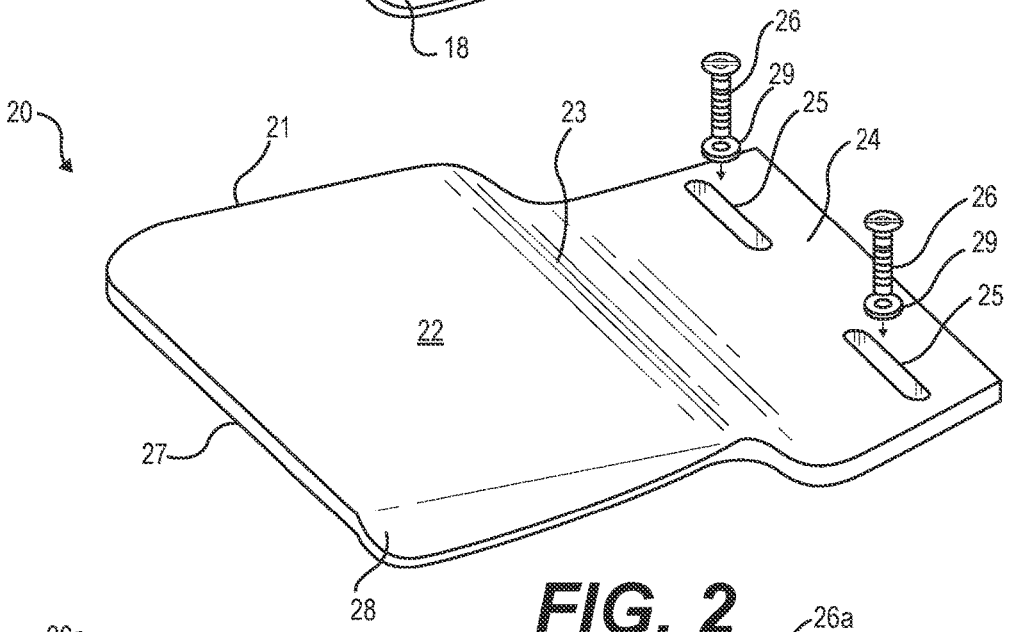
FIG. 2 illustrates a perspective view of a replacement finishing blade having a pair of elongated screw securing slots of the first embodiment according to the present invention.

FIG. 2 is very similar to the prior art of FIG. 1 as discussed above, except for the uniqueness of the pair of screw holes having an elongated shape. The surface finishing replacement blade unit being designated as 20 includes a replacement finishing blade 21 having a surface contact portion 22, an intermediate angular portion 23 that extends from the surface contact portion 22, and a raised rear flat attachment portion 24 that is integrally connected and extends angularly away from the intermediate portion 13. The raised rear flat attachment portion 24 includes a pair of attachment screw slots 25 that is elongated in shape and is disposed therein, a pair of screw members 26 to be received within the elongated screw holes 25 and a pair of washers 29 adapted to receive the pair of screw members 26. Also, the replacement finishing blade 21 further includes a trailing edge 27, and an outer bent edge 28.

The inventive concept of the elongated shaped screw slots 25 will now be discussed. These elongated shaped screw slots 25 will allow the replacement finishing blade 21 to be selectively adjusted at or near an annular peripheral edge of a rotary disk or stabilizer (not shown) to allow for smooth finishing at wall structures and around an electrical or plumbing stub obstructions within concrete and other viscous or plastics surfaces, thus eliminating the need for any additional labor intensive hand finishing.

A further inventive concept of the elongated shaped screw slots 25 is designed to allow the replacement finishing blade 21 to be selectively adjusted at or near an annular peripheral edge of an annular free-wheeling or free-rotating bearing guide ring assembly 50, 60, 70 as referenced in FIGS. 5A-5B and 6A-C of the instant application. Note that details of the annular free-wheeling or free-rotating bearing guide ring assembly 50, 60, 70 will be discussed later.

The selective adjustment of the screw members 26 within the elongated slots 25 will allow the replacement finishing blade 21 to finish right at wall structures and around electrical or plumbing stub obstructions within concrete and other viscous or plastic surfaces, while allowing for smooth finishing at the wall structures and around the electrical or plumbing stub obstructions upon the annular free-wheeling bearing guide ring assembly 50, 60, 70 engaging the wall structures and the electrical or plumbing stub obstructions without damaging or marking thereto, thus eliminating the need for any additional labor intensive hand finishing.

Figure 2A:
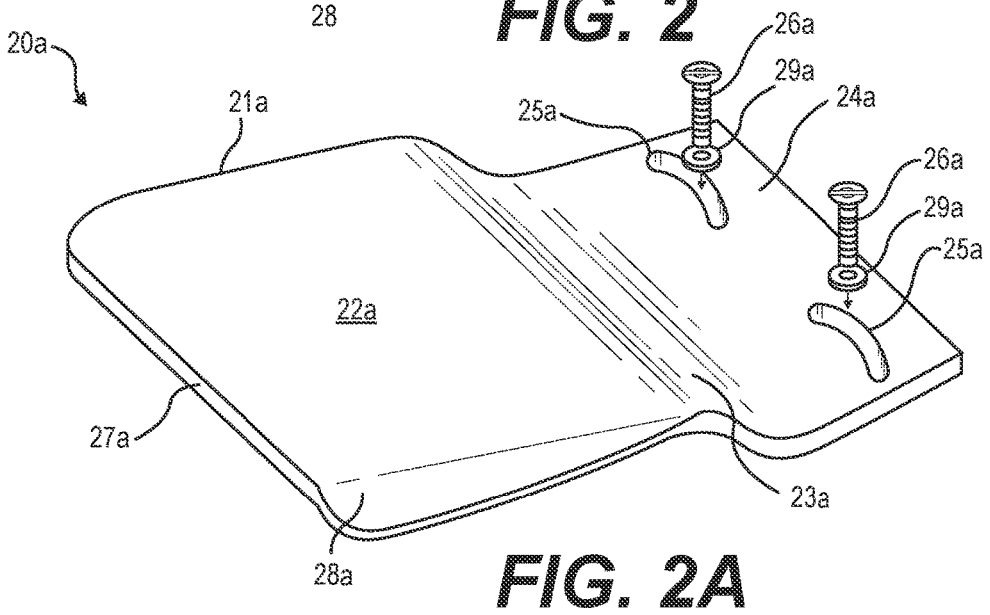
FIG. 2A illustrates a perspective view of a replacement finishing blade having a pair of arcuate or bow-shaped elongated screw securing slots of the second embodiment according to the present invention.

Now referring to FIG. 2A, this embodiment is the same as FIG. 2 with the same reference numerals represented with "a". The surface finishing replacement blade unit is designated as 20*a* includes a replacement finishing blade 21*a* having a surface contact portion 22*a*, an intermediate angular portion 23*a* that extends from the surface contact portion 22*a*, and a raised flat rear disk attachment portion 24*a* that is integrally connected and extends angularly away from the intermediate portion 23*a*. The raised flat rear disk attachment portion 24*a* includes a pair of attachment screw slots 25*a* having an elongated arcuate or bow shape disposed therein, a pair of screw members 26*a* adapted to be received within the elongated arcuate or bow-shaped screw slots 25*a* and a pair of washers 29*a* adapted to receive the pair of screw members 26*a*. Also, the replacement finishing blade 21*a* further includes a trailing edge 27*a*, and an outer bent edge 28*a*.

In order to not be redundant, the inventive concepts and operation of FIG. 2A is the same as FIG. 2 as discussed above with the only exception being that elongated slots 25 and 25*a* have different shaped slots.

Figure 3A:
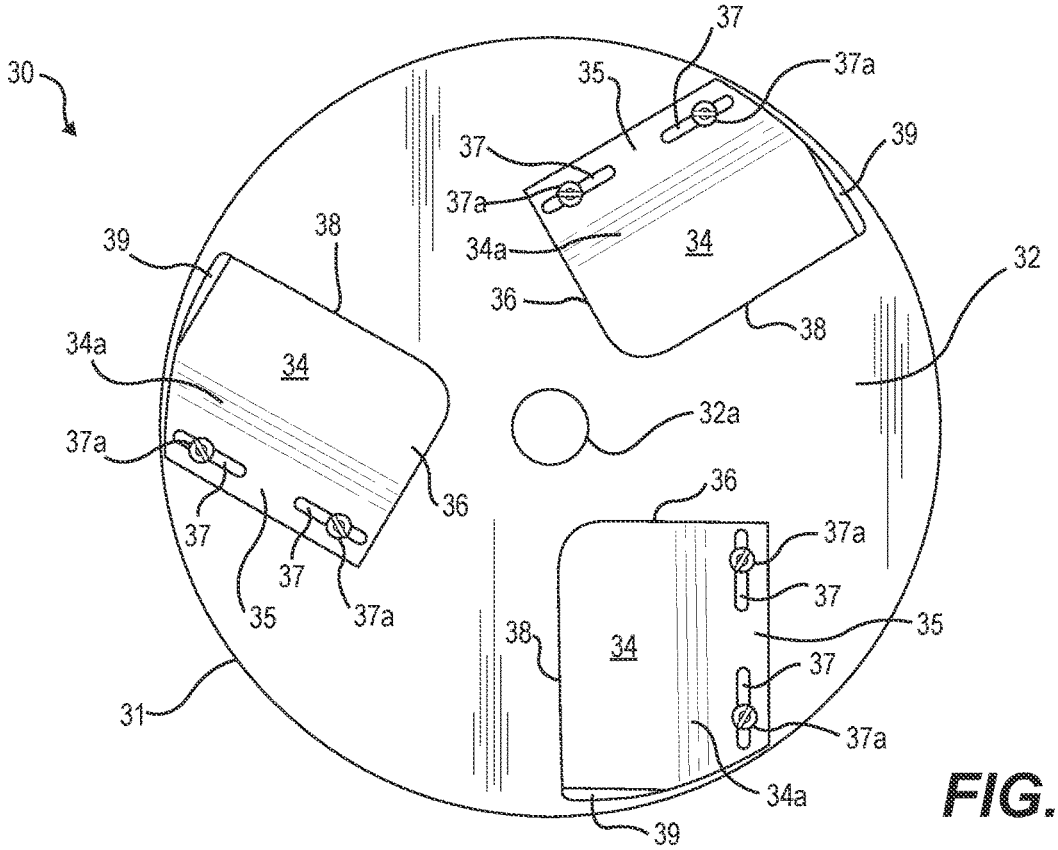
FIG. 3A illustrates a perspective bottom view of a selective sized rotary stabilizer or disk with at least three equally spaced replacement finishing blades secured thereto by a pair of screw members that are selectively adjustable via a pair of elongated screw securing slots of the first embodiment according to the present invention.
Figure 3B:
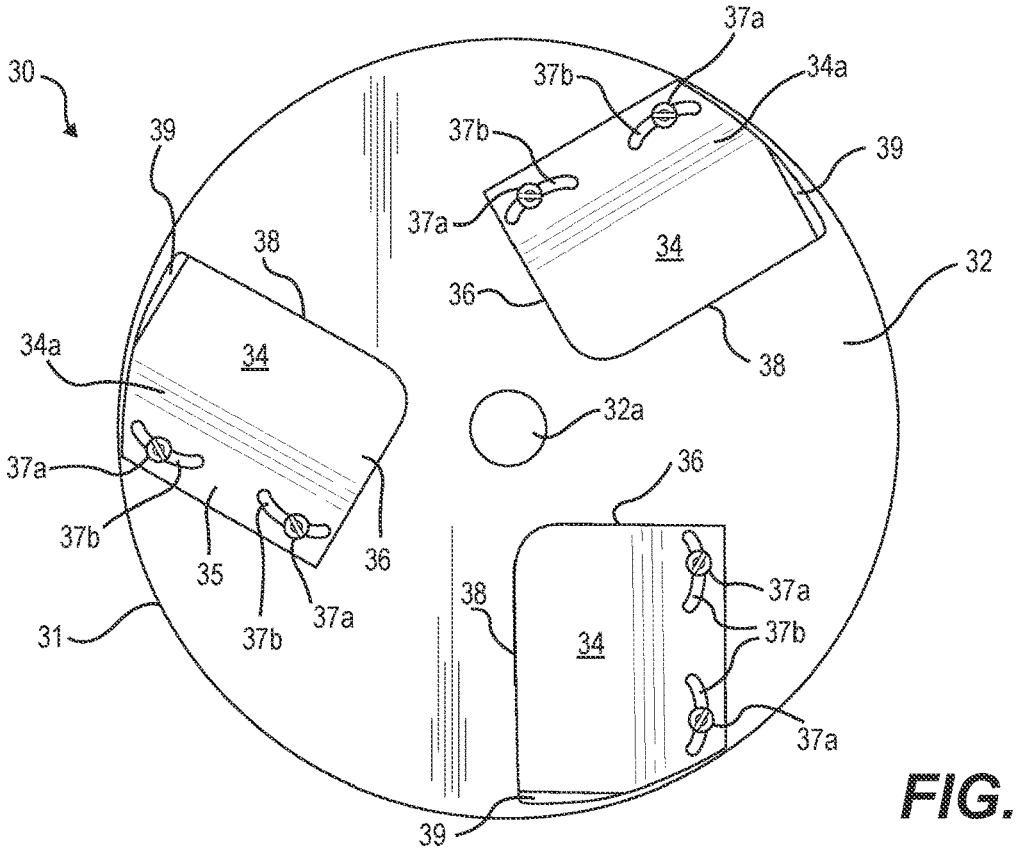
FIG. 3B illustrates a perspective bottom view of a selective sized rotary stabilizer or disk with at least three equally spaced replacement finishing blades secured thereto by a pair of screw members that are selectively adjustable via a pair of arcuate or bow-shaped elongated screw securing slots of the second embodiment according to the present invention.

Note that FIGS. 3A and 3B are identical except that the elongated screw slot reference numeral in FIG. 3A is represented by reference numeral 37 and the elongated arcuate or bow-shaped screw slot in 3B is represented by reference numeral 37*b*.

FIGS. 3A and 3B shows bottom perspective views of the present invention, which shows a rotary stabilizer or disk assembly 30. The rotary stabilizer or disk assembly 30 includes a rotary stabilizer or disk 31 with a bottom surface 32, a concentric power tool shaft attachment passage 32*a* that is configured to fit about an output shaft of a power tool for securing the rotary stabilizer or disk 31 thereto and driving the rotary stabilizer or disk 31, a plurality of selectively spaced and adjustable replacement finishing blades 36, each of the plurality of selectively spaced and adjustable replacement finishing blades 36 having a surface contact portion 34, an intermediate portion 34*a* that extends angularly from the surface contact portion 34, and a raised flat rear disk attachment portion 35 that is integrally connected and extends angularly away from the intermediate portion 34*a*. The raised flat rear disk attachment portion 35 includes a pair of attachment screw slots 37 that is elongated in shape and is disposed therein, a pair of screw members 37*a* adapted to be received within the elongated screw slots 37 to secure the plurality of selectively spaced and adjustable replacement finishing blades 36 to the rotary stabilizer or disk 31. Also, the plurality of selectively spaced and adjustable replacement blades 36 further includes a trailing edge 38, and an outer bent edge 39.

To not be redundant, FIG. 3B as stated above is the same as FIG. 3A except for the shapes of the elongated shaped slots 37 and 37*b*. The elongated slot in FIG. 3B shows an arcuate or a bow-shaped screw slot. Note that the reference numerals are identical to the ones described in FIG. 3A. Therefore, a description of FIG. 3B is not deemed necessary since the same information has been fully described above in FIG. 3A.

However, the inventive concept of the elongated shaped screw slots 37 will now be discussed. These elongated shaped screw slots 37 will allow the replacement finishing blade 36 to be selectively adjusted at or near an annular peripheral edge of a rotary stabilizer or disk in order to finish right at wall structures and around electrical or plumbing stub obstructions disposed within concrete and other viscous or plastic surfaces, while allowing for smooth finishing at the wall structures and around the electrical or plumbing stub obstructions, thus eliminating the need for any additional labor intensive hand finishing.

A further inventive concept of the elongated shaped screw slots 37 and the arcuate or bow-shaped screw slots 37*b* are configured to allow the replacement finishing blades 36 to be selectively adjusted at or near an annular peripheral edge of an annular free-wheeling bearing guide ring assembly 50, 60, 70 as referenced in FIGS. 5A-5B and 6A-6C of the instant application. Note that the annular free-wheeling or free-rotating bearing guide ring assembly 50, 60, 70 will be discussed later in greater details below.

The selective adjustment of the screw members 37*a* within the elongated shaped screw slots 37 and the arcuate or bow-shaped screw slots 37*b* will allow the replacement finishing blades 36 to finish right at wall structures and around electrical or plumbing stub obstructions within concrete and other viscous or plastic surfaces, while allowing for smooth finishing at the wall structures and around the electrical or plumbing stub obstructions upon the annular free-wheeling bearing guide ring assembly 50, 60, 70 engaging the wall structures and the electrical or plumbing stub obstructions without damaging or marking thereto, thus eliminating the need for any additional labor intensive hand finishing.

Figure 4A:
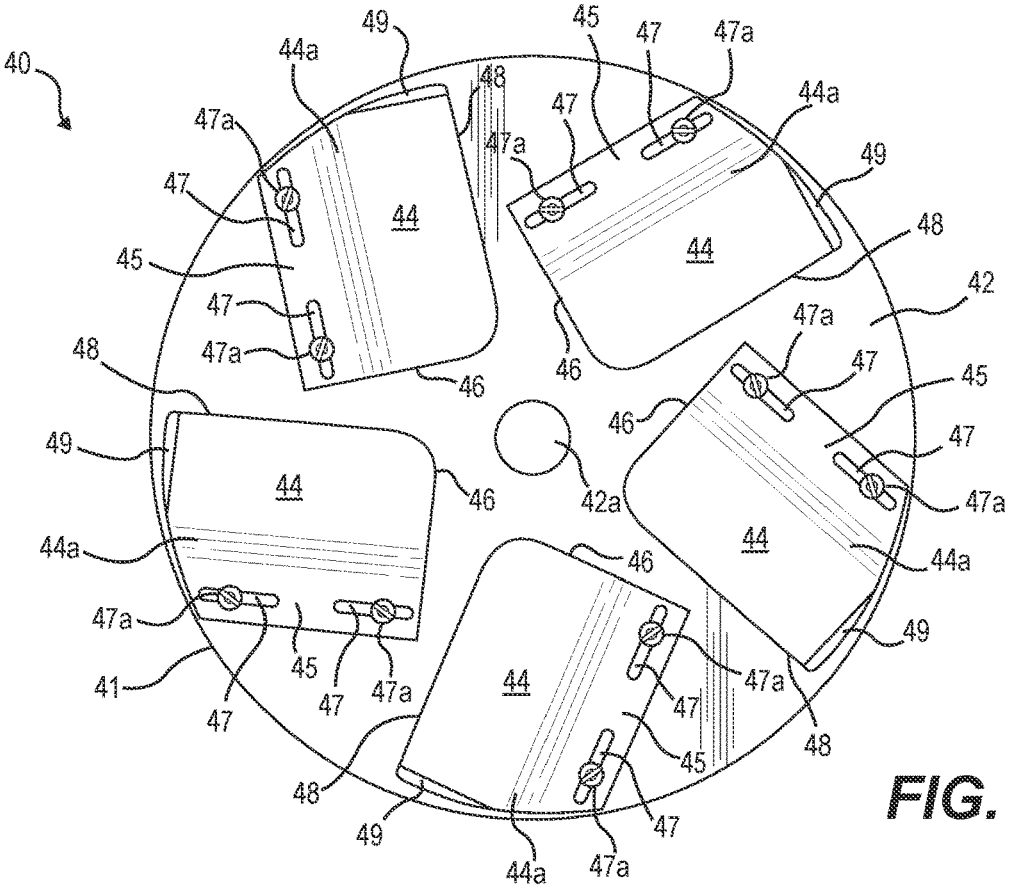
FIG. 4A illustrates a perspective bottom view of a selective sized rotary stabilizer or disk with at least four equally spaced replacement finishing blades secured thereto by a pair of screw members that are selectively adjustable via a pair of elongated screw securing slots of the first embodiment according to the present invention.
Figure 4B:
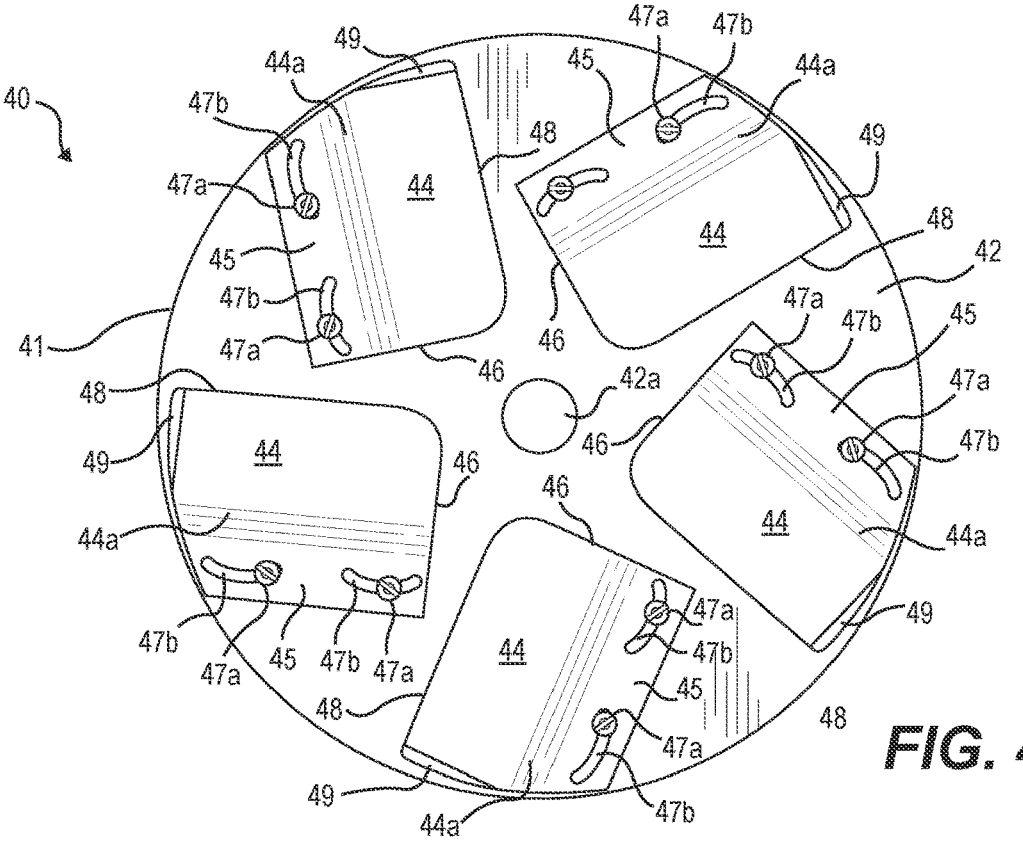
FIG. 4B illustrates a perspective bottom view of a selective sized surface finishing rotary stabilizer or disk with at least four equally spaced replacement finishing blades secured thereto by a pair of screw members that are selectively adjustable via a pair of arcuate or bow-shaped elongated screw securing slots of the second embodiment according to the present invention.

FIGS. 4A and 4B are identical except that the elongated screw slot reference numeral in FIG. 3A is represented by reference numeral 47 and the elongated arcuate or bow-shaped screw slot in 3B is represented by reference numeral 47*b*.

Note that FIGS. 4A and 4B shows bottom perspective views of the present invention, which shows a rotary stabilizer or disk assembly 40. The rotary stabilizer or disk assembly 40 includes a rotary stabilizer or disk 41 with a bottom surface 42, a concentric power tool shaft attachment passage 42*a* that is configured to fit about an output shaft of a power tool for securing the rotary stabilizer or disk 41 thereto and driving the rotary stabilizer or disk 41, a plurality of selectively spaced and adjustable replacement finishing blades members 46, each of the plurality of selectively spaced and adjustable replacement finishing blades 46 having a surface contact portion 44, an intermediate angular portion 44*a* that extends from the surface contact portion 44, and a raised flat rear disk attachment portion 45 that is integrally connected and extends angularly away from the intermediate portion 44*a*. The raised flat rear disk attachment portion 45 includes a pair of attachment screw slots 37 that is elongated in shape and is disposed therein, a pair of screw members 47*a* adapted to be received within the elongated shaped screw slots 47 and the elongated arcuate or bow-shaped screw slots 47*b* to secure the plurality of selectively spaced and adjustable replacement finishing blades 46 to the rotary finishing stabilizer or disk 41. Also, the plurality of selectively spaced and adjustable replacement blades 46 further includes a trailing edge 48, and an outer bent edge 49.

Details of FIG. 4B will not be discussed since it is the same as FIG. 4A except for the elongated arcuate or bow-shaped screw slots 47*b* to eliminate redundancy and the number of selectively spaced and adjustable replacement finishing blades 46 secured to the rotary stabilizer or disk 41. Note that the inventive concept and purpose for the elongated arcuate or bow-shaped screw slots 47*b* is the same as discussed above for the elongated screw slots in FIGS. 2, 3A and 4A.

Another inventive concept as shown in FIGS. 3A, 3B, 4A and 4B is that the rotary surface finishing stabilizers or disks 31 and 41 can be of different selective sizes and adaptable to accommodate a different number of selectively sized and adjustable replacement finishing blade members 36 and 46.

In addition, the selective positions of the plurality of screw members 47*a* in FIG. 4B are designed to accommodate for any slightly offset manufactured screw holes 51*c* (see FIGS. 8A and 8B) in the rotary finishing stabilizer or disk 41. Therefore, if the manufactured screw holes 51*c* are slightly offset they can easily line up with the elongated shaped screw slots 25, 37 and 47 as shown in FIGS. 2, 3A and 4A and the elongated arcuate or bow-shaped screw slots 25*a*, 37*b* and 47*b* as shown in FIGS. 2A, 3B, 4B and 5C in order for the plurality of screw members 26, 26*a*, 37*a* and 47*a* as shown in FIGS. 2A, 3B, 4B and 5C to easily pass there through and into the manufactured screw holes 51*c*. Such an alignment will allow the plurality of selectively spaced and adjustable replacement finishing blades 21, 21*a* 36 and 46 to be secured and selectively positioned near or at the annular peripheral edge of the rotary stabilizers or disks 31, 41, 51 and 61 to achieve a smooth finish over a concrete and other viscous or plastic surfaces, as well as, finishing smoothly along wall structures and around electrical or plumbing stub obstructions within concrete and other viscous or plastic surfaces, thus eliminating extensive hand labor with a hand trowel by a user or worker.

It is to be noted that the above offset alignment accommodation between the screw holes 51*c* and the elongated shaped screw slots 25, 37 and 47 and the elongated arcuate or bow-shaped screw slots 25*a*, 37*b* and 47*b* eliminates a user from having to replace a rotary finishing stabilizer or disk due to any offset manufactured holes 51*c*, whereby a user would have to replace a rotary finishing stabilizer or disk with the pair of single-type screw holes 15 of the plurality of spaced apart replacement finishing blades 21 as shown in the prior art as illustrated above in FIG. 1.

Another inventive concept of the present invention provides the screw members 26, 26*a*, 37*a* and 47*a* as shown in FIGS. 2A, 3B, 4B and 5C with a selective fine pitch thread. The selective fine thread screw members 26, 26*a*, 37*a* and 47*a* extend through the rotary finishing disks 31, 41, 51 and 61 at a selective distance at a top portion thereof that will prevent debris, concrete, and other viscous or plastic material from penetrating into the threaded screw holes 51*c* of the rotary finishing stabilizers or disks 31, 41, 51 and 61 and preventing damage to the threads that can cause loosening and wobbling of the plurality of selectively spaced and adjustable replacement finishing blades 21, 21*a* 36 and 46 relative to the rotary finishing stabilizers or disks 31, 41, 51 and 61.

Figure 5A:
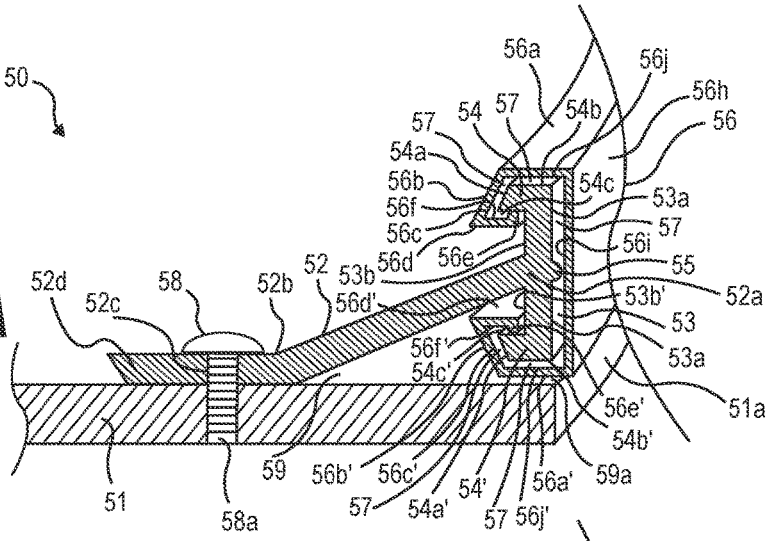
FIG. 5A illustrates a cut sectional side view of a free-wheeling bearing guide ring assembly having a non-rotary ring with a plurality of spaced apart non-rotating arm members and a plurality of integral connector screw tabs secured to a rotary stabilizer or disk and an annular free-rotating or free-wheeling bearing cover guide ring member fastened thereto by a plurality of upper and lower clip fastening members with a fastener bead to allow it to move without binding along a bearing rail and spacer member of each of the plurality of spaced apart non-rotating arm members of the annular non-rotary ring of the first embodiment according to the present invention.

FIG. 5A illustrates a cut sectional side view of a free-wheeling or free-rotating bearing guide ring assembly 50 having a first member as a non-rotating ring 53 including a plurality of spaced apart non-rotating arm members 52 with a forward end extending and secured to an intermediate intersecting location on a clip fastening structure 52*a* of each of the plurality of spaced apart non-rotating arm members 52, and a rear end extending and secured to a plurality of integral connector screw tabs 52*d* with a screw opening 52*c* disposed therein for securing the plurality of spaced apart non-rotating arm members 52 to a rotary finishing stabilizer or disk 51 via a screw opening 58*a* disposed therein by a screw member 58.

Further, each of the plurality of spaced apart non-rotating arm members 52 are angled upward from a bent location or section 52*b* at a front end of the integral connector tabs 52*d* to a rear inner face surface at the intermediate intersecting location along the non-rotary ring 53 having an upper portion 53*b* and a lower portion 53*b*' of the clip fastening structure 52*a*. The upper portion 53*b* and the lower portion 53*b*' having an upper radial extending clip fastening member 54 and a lower radial extending clip fastening member 54' of the clip fastening structure 52*a*, which are identical. The upper radial extending clip fastening member 54 includes a top end portion 54*b*, an outward tapered or bevel rear end portion 54*a*, and a bottom end portion 54*c* extending inward from the outward tapered or bevel rear end portion 54*a*.

Note that the lower radial extending clip fastening member 54' is the reverse or flip position of the upper radial extending clip fastening member 54. Therefore, the lower radial extending clip fastening member 54' includes a top end portion 54*c*', an outward tapered or bevel rear end portion 54*a*', and a bottom end portion 54*b*' extending inward from the outward tapered or bevel rear end portion 54*a*' extending towards a front end 51*a* of the rotary finishing disk or stabilizer but selectively spaced from a peripheral edge of the front end 51*a*. The purpose for the selective spacing will be discussed in greater detail later.

Between the upward angled plurality of spaced apart non-rotating arm members 52 and the rotary finishing stabilizer or disk 51 an open clearance space 59 is formed therebetween. The lower radial extending clip fastening member 54' is disposed within the open clearance space 59. Therefore, the bottom end portion **54*b*' is positioned within the open clearance space 59 at a selective distance above the top portion of the rotary finishing stabilizer or disk 51 creating a clearance gap 59*a*** therebetween.

Further, each of the plurality of spaced apart non-rotating arm members 52 includes a front outer face surface **53*a*. The front outer face surface 53*a* of each of the plurality of spaced apart non-rotating arm members 52 having a self-lubricating bearing rail and spacer member 55 disposed along an intermediate portion thereof, and opposite the integral end of each of the plurality of spaced apart non-rotating arm members 52 attached to the rear inner face surface between the upper portion 53*b* and a lower portion 53*b*' at the intermediate intersecting location of the clip fastening structure 52*a***.

A free-wheeling bearing guide ring assembly 50 of the present invention having a second member including an upper clip member and a lower clip member that are removably attached to the clip fastening structure **52*a* for free movement there along in different directions about the annular non-rotating ring 53** at its upper and lower ends thereof.

Further in FIG. 5A, the upper clip member of the free-wheeling bearing guide ring assembly 50 includes a second member defined as an annular free-rotating bearing cover guide ring 56. The upper clip member of the annular free-rotating bearing cover guide ring 56 having an annular top outer portion **56*a*, an annular top inner portion 56*j*, an annular bottom end portion 56*d*, an annular bottom inner end portion 56*f*, an annular front outer face portion 56*h*, an annular rear inner face portion 56*i*, an annular tapered or bevel rear outer end portion 56*b*, and an annular tapered or bevel rear inner end portion 56*c* forming an annular clip fastening device. The annular top outer portion 56*a* extends radially from the front outer face portion 56*h* and the annular rear inner face portion 56*i* and outwardly connected to the annular tapered or bevel outer rear end portion 56*b* and the annular tapered or bevel inner rear end portion 56*c*, and the annular bottom outer end portion 56*d* extending inward from the annular outer tapered or bevel end portion 56*b* and the annular bottom inner end portion 56*f* to a bead fastening member 56*e***.

The lower clip member of the annular free-rotating bearing cover guide ring 56 is a reverse orientation of the upper clip member of the annular free-rotating bearing cover guide ring 56. This means that the annular top outer portion **56*a* of the upper clip member represents the bottom outer end portion 56*a*' of the lower clip member and the bottom outer end portion 56*d* of the upper clip member represents the annular top outer portion 56*d*'**. Therefore, the referenced elements of the lower clip member will now be discussed.

In FIG. 5A, the lower clip member of the annular free-rotating bearing cover guide ring 56 having an annular top outer portion **56*d*', an annular top inner portion 56*f*, an annular bottom outer end portion 56*a*', an annular bottom inner end portion 56*j*', an annular front outer face portion 56*h*, an annular rear inner face portion 56*i*, an annular tapered or bevel rear outer end portion 56*b*', and an annular tapered or bevel rear inner end portion 56*c*' forming an annular clip fastening device. The annular top outer portion 56*d*' extends radially inward from the annular tapered or bevel outer rear end portion 56*b*' and the annular top inner portion 56*f*' extends radially inward from the annular tapered or bevel inner rear end portion 56*c*' to a fastening bead member 56*e*'. Further, the bottom outer end portion 56*a*' extends radially from the front outer face portion 56*h* and outwardly connected to the annular tapered or bevel outer rear end portion 56*b*' and the bottom inner end portion 56*j*' extends radially from the front outer face portion 56*h* and outwardly connected to the annular tapered or bevel inner rear end portion 56*c*'**.

In operation, the upper clip member **56*a*-56*j* of the annular free-rotating or free-wheeling bearing cover guide ring member 56 is received over the upper part of the clip fastening structure 52*a* and the upper clip fastening member 53*a*-53*b*, and 54-54*j* and the lower clip fastening member 56*a*'-56*j*' of the annular free-rotating bearing cover guide ring member 56 is received over a lower part of the clip fastening structure 52*a* and the lower clip fastening member 53*a*'-53*b*' and 54'-54*j*'. When this fastening takes place, the upper fastening bead member 56*e* of the annular free-rotating bearing cover guide ring member 56 will snap underneath and engage the upper bottom end surface portion 54*c* of each of the plurality of spaced apart non-rotating arms 52 and the lower fastening bead member 56*e*' of the annular free-rotating bearing cover guide ring 56 will snap over and engage the lower top end surface portion 54*c*' of each of the plurality of spaced apart non-rotating arms 52. Once this happens, the rear inner face surface 56*i* of the annular free-rotating bearing cover guide ring member 56 encloses the front outer face surface 53*a* of each of the plurality of spaced apart non-rotating arm members 52 and the clip fastening structure 52*a* and engages the annular bearing rail and spacer member 55 of each of the annular non rotary ring 53 plurality of spaced apart non-rotating arm members 52**.

The engagement of the annular free-rotating or free-wheeling bearing cover guide ring member 56 against the annular bearing rail spacer member 55 of the non-rotary ring 53 forms an annular space 57 between the front outer face surface **53*a* of the non-rotating ring 53, the rear inner face surface 56*i* of the annular free-rotating or free-wheeling bearing cover guide ring member 56, the upper part of the clip fastening structure 52*a* and the upper clip fastening member 53*a*-53*b*, and 54-54*j* and a lower part of the clip fastening structure 52*a* and the lower clip fastening member 53*a*'-53*b*' and 54'-54*j*'. This space allows the annular free-rotating or free-wheeling bearing cover guide ring member 56 to rotate freely without any binding around and along each of the plurality of spaced apart non-rotating arms 52 of the non-rotary ring 53. Also, the annular free-rotating or free-wheeling bearing cover guide ring member 56 is able to rotate freely in different direction around and along each of the plurality of spaced apart non-rotating arm members 52 when the annular free-rotating or free-wheeling bearing cover guide ring member 56 abuts or engages a wall structure, and plumbing or electrical stub obstructions upstanding in a concrete or viscous material surface during a concrete or viscous material smoothing and finishing operation. This abutment or engagement of the annular free-rotating or free-wheeling bearing cover guide ring member 56** against the wall structure, and the plumbing or electrical stub obstructions will eliminate markings or damage thereto.

The dimension of the clearance gap **59*a* formed between the bottom end portion 54*b*' and the top portion of the rotary finishing stabilizer or disk decreases after the annular free-rotating bearing cover guide ring 56 is fastened to the annular non-rotary ring 53, but the decrease in the dimension of the clearance gap 59*a* will still be sufficient to prevent the annular free-rotating bearing cover guide ring 56 from hitting the top of the rotary finishing stabilizer or disk 51** during a concrete or viscous material smoothing operation.

Figure 5B:
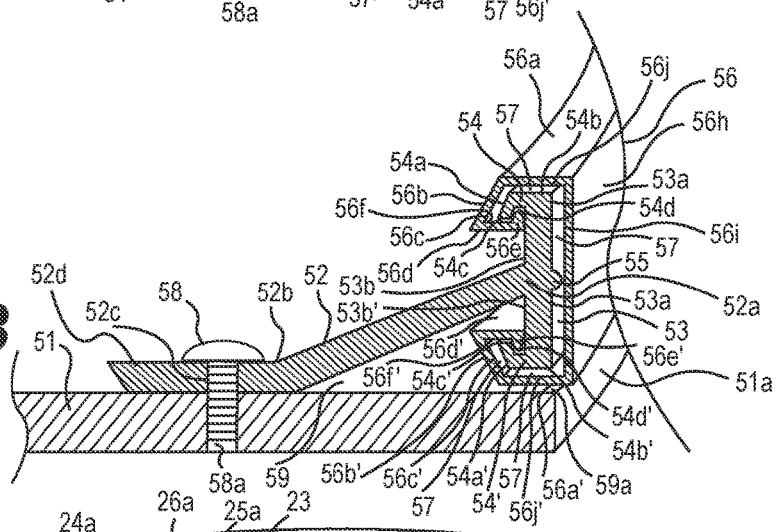
FIG. 5B illustrates a cut sectional side view of a free-wheeling or free-rotating bearing guide ring assembly having plurality of spaced apart non-rotating arm members and a plurality of integral connector screw tabs secured to a rotary stabilizer or disk and an annular free-rotating or free-wheeling bearing cover guide ring member fastened thereto by a plurality of upper and lower clip fastening members with a fastener bead and groove to allow it to move without binding along a bearing rail and spacer member of each of the plurality of spaced apart non-rotating arm members of the non-rotary ring of a second embodiment according to the present invention.

FIG. 5B illustrates a cut sectional side view of a free-wheeling bearing guide ring assembly 50 having plurality of spaced apart non-rotating arm members 52 and a plurality of integral connector screw tabs 52*d* secured to a rotary surface finishing stabilizer or disk 51 and an annular free-wheeling bearing cover guide ring 56 fastened thereto and freely movable along a self-lubricating bearing rail and spacer member 55 of the annular non-rotary ring 53 of a second embodiment according to the present invention.

Note that FIG. 5B is identical to FIG. 5A as explained above except that each one of the bottom end portion 54*c* of the upper radial extending clip fastening member 54 and the top end portion 54*c*' of the lower radial extending clip fastening member 54' includes an annular channel or groove 54*d* and 54*d*', respectively, within the annular non-rotary ring 53 and the clip fastening structure 52*a* to snap fit the fastening bead member 56*e* and 56*e*' therein to allow the annular free-wheeling bearing cover guide ring 56 to rotate freely along and around the annular non-rotary ring 53 without any binding. Therefore, no additional information is necessary for explanation purposes since 5B is the same as 5A as stated above. All of the reference elements are the same except for the above exception.

Figure 5C:
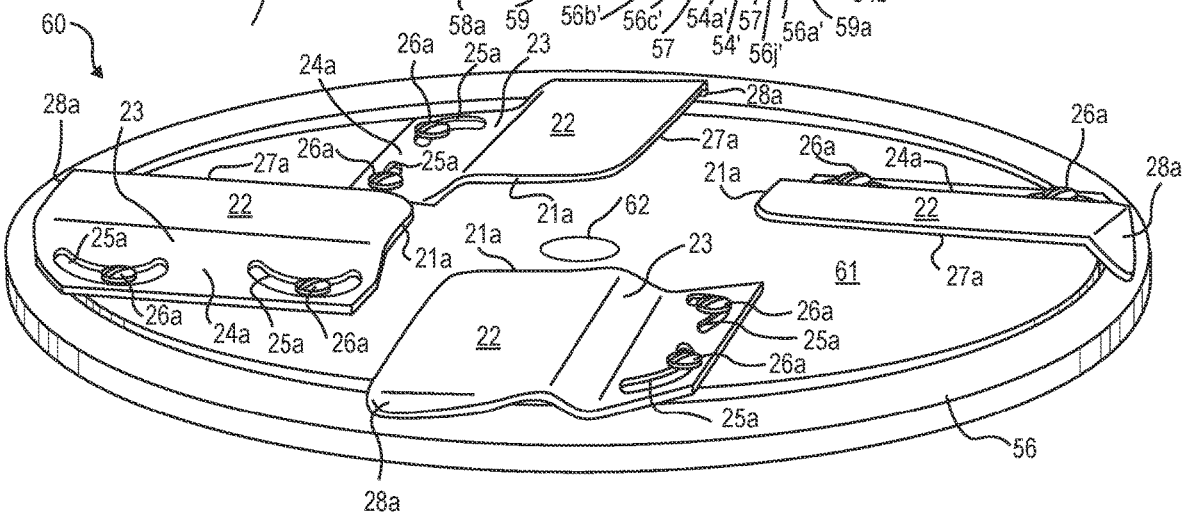
FIG. 5C illustrates a bottom perspective view of a free-wheeling or free-rotating bearing guide ring assembly disposed around an annular peripheral edge of a rotary stabilizer or disk with a plurality of replacement blades secured to the rotary stabilizer or disk via a pair of arcuate or bow-shaped elongated slots that are selectively adjusted along and adjacent to the annular peripheral edge thereof, and within and along an annular peripheral edge of the free-wheeling or free-rotating bearing cover guide ring member according to the present invention.

Now referring to FIG. 5C, which illustrates a bottom perspective view of the free-wheeling bearing guide ring assembly 60 with a plurality of selectively spaced and adjustable replacement finishing blades 21*a* secured to a rotary stabilizer or disk 61 at and along an annular peripheral edge thereof via a pair of arcuate or bow-shaped elongated slots 25*a* according to the present invention. The rotary stabilizer or disk 61 includes a concentric power tool shaft attachment passage 62*a* that is configured to fit about an output shaft of a power tool 82 (see FIG. 7) for securing the rotary stabilizer or disk 61 thereto and driving the rotary stabilizer or disk 61 with the plurality of selectively spaced and adjustable replacement finishing blade members 21*a* disposed thereon, each of the plurality of selectively spaced and adjustable replacement finishing blade members 21*a* having a surface contact portion 22, an intermediate angular portion 23 that extends from the surface contact portion 22, and a raised flat rear disk attachment portion 24*a* that is integrally connected and extends angularly away from the intermediate portion 23.

The raised flat rear disk attachment portion 24*a* includes a pair of elongated arcuate or bow-shaped attachment screw slots 25*a* disposed therein, a pair of screw members 26*a* adapted to be received within the elongated arcuate or bow-shaped attachment screw slots 25*a* to secure the plurality of selectively spaced and adjustable replacement finishing blades 21*a* to the rotary stabilizer or disk 61. Also, the plurality of selectively spaced and adjustable replacement blades 21*a* further includes a trailing edge 27*a*, and an outer bent edge 28*a*. As shown in FIG. 5C, the plurality of selectively spaced and adjustable replacement finishing blade members 21*a* having the bent edge 28*a* selectively adjusted at or near an annular peripheral edge of the annular free-rotating or free-wheeling bearing cover guide ring member 56 to allow smooth finishing at wall structures, and electrical and plumbing stubs upon the annular free-rotating or free-wheeling bearing cover guide ring member 56 engaging or abutting against the wall structures, and the electrical and plumbing stubs without causing any damage and markings thereto.

Figure 6A:
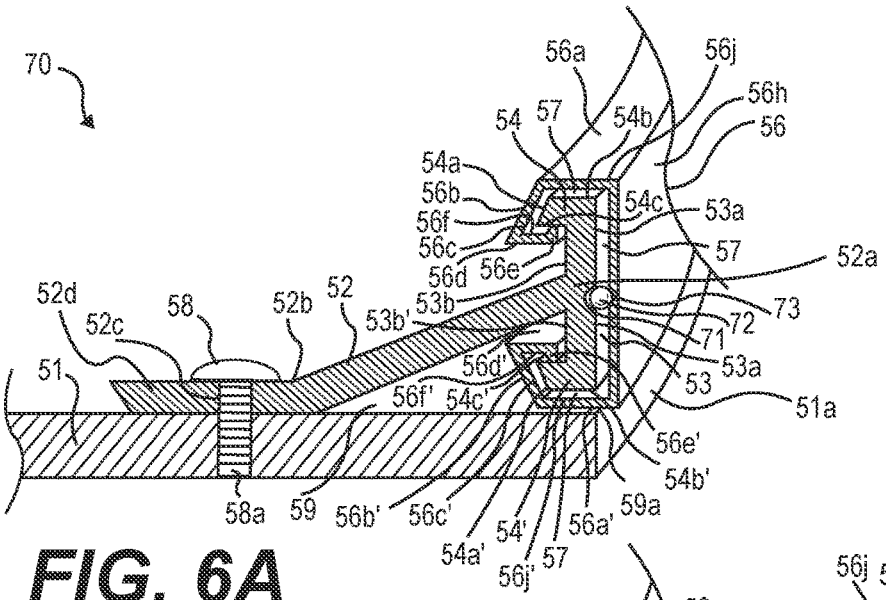
FIG. 6A illustrates a cut sectional side view of a free-rotating or free-wheeling bearing guide ring assembly having a non-rotating ring with a plurality of spaced apart non-rotating arm members, each of the plurality of spaced apart non-rotating arm members having an integral connector screw tab secured to a rotary stabilizer or disk and an annular free-rotating or free-wheeling bearing cover guide ring member fastened thereto by a plurality of upper and lower clip fastening members having a fastener bead to allow it to move along a plurality of spaced apart self-lubricating bearing members disposed within an annular a channel or cavity in a front outer face surface of each of the plurality of spaced apart non-rotating arm members and along an annular channel or cavity in a rear inner face surface of the free-rotating or free-wheeling bearing cover guide ring member according to the present invention.
Figure 6B:
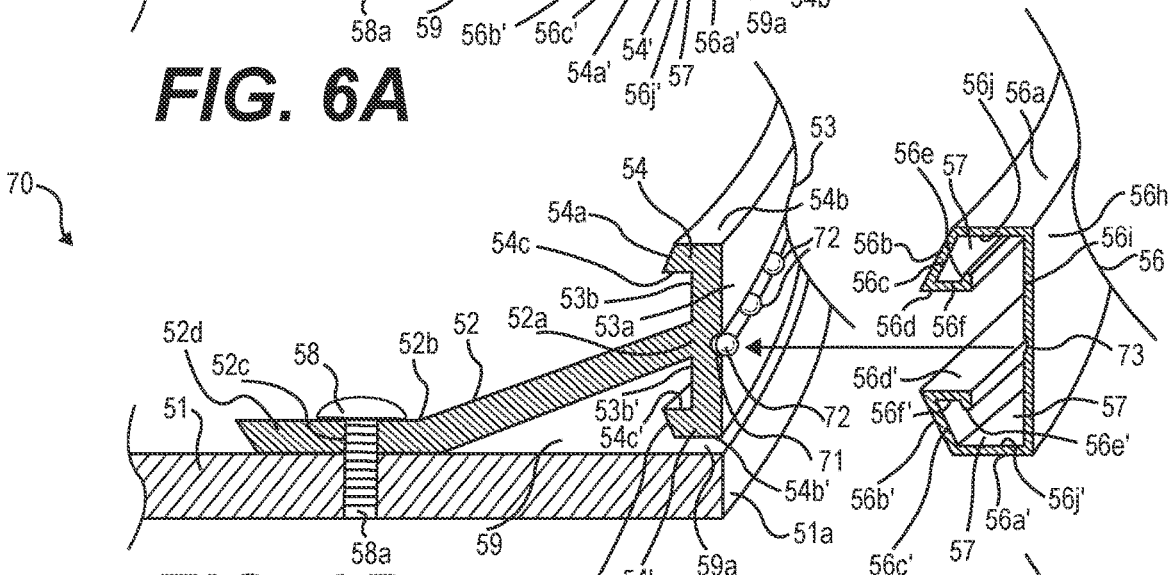
FIG. 6B illustrates an exploded cut sectional side view of a free-rotating or free-wheeling bearing guide ring assembly having a non-rotating ring with a plurality of spaced apart non-rotating arm members, each of the plurality of spaced apart non-rotating arm members having a connector screw tab secured to a rotary finishing stabilizer or disk and an annular free-rotating bearing cover guide ring detached therefrom with a plurality of spaced apart self-lubricating bearing members disposed within a channel or cavity in a front outer face surface of each of the plurality of spaced apart non-rotating arm members and spaced from and along an annular channel or cavity in a rear inner face surface of the free-rotating or free-wheeling bearing cover guide ring member according to the present invention.
Figure 6C:
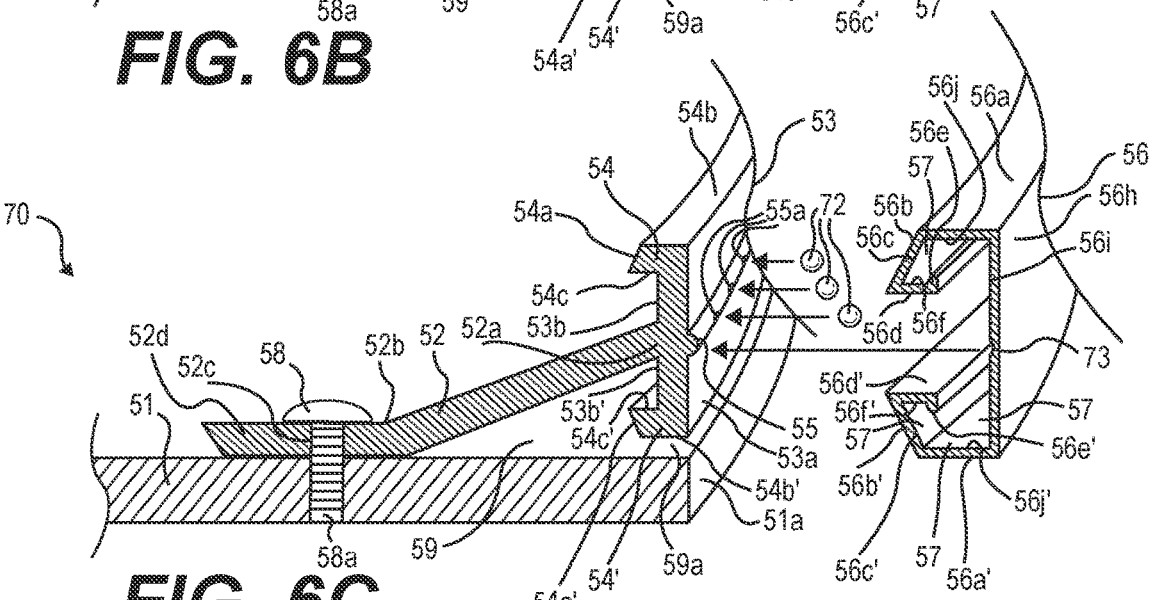
FIG. 6C illustrates an exploded cut sectional side view of a free-rotating or free-wheeling bearing guide ring assembly having a non-rotating ring with a plurality of spaced apart non-rotating arm members, each of the plurality of spaced apart non-rotating arm members having a connector screw tab secured to a rotary stabilizer or disk and an annular free-rotating or free-wheeling bearing cover guide ring member being detached therefrom, a bearing rail and spacer member with a plurality of spaced apart holes disposed in a front outer face surface of each of the plurality of spaced apart non-rotating arm members for receiving a self-lubricating bearing member in each of the plurality of spaced apart holes and being spaced therefrom, as well as being spaced from an annular channel or cavity in a rear inner face surface of the free-rotating or free-wheeling bearing cover guide ring member according to the present invention.

FIGS. 6A-6C are very similar to FIGS. 5A-5B, except for having annular self-lubricating bearing rail and spacer arrangements of FIGS. 6A-6C that are different from the annular self-lubricating bearing rail and spacer member 55 as shown in FIGS. 5A-5B. In FIGS. 6A and 6B, the self-lubricating bearing and spacer member includes an annular a channel or groove 71 in the annular front face 53*a* of each of the plurality of spaced apart non-rotating arm members 52 of the non-rotary ring 53 that either receives at least a bearing rail with a plurality of spaced apart self-lubricating bearings 72 disposed therein, a plurality of separate and spaced bearing rails maybe disposed within the annular channel or groove 71 with a plurality of self-lubricating bearings 72 disposed therein, or a plurality of spaced apart self-lubricating bearings 72 snap-fitted within the annular channel or groove 71 in the annular front outer face 53*a* of each of the plurality of spaced apart non-rotating arm members 52 of the non-rotary ring 53. Also, the inner rear face 56*i* of the annular free-wheeling or free-rotating bearing cover guide ring member 56 includes an annular channel or groove 73 that receives the outer portion of the self-lubricating bearings 72 that acts as a bearing rail and spacer member.

The exploded view of FIG. 6C shows a bearing rail and spacer member 55 with a plurality of spaced apart holes 55*a* disposed therein for receiving a self-lubricating bearing in each one of the plurality of spaced apart holes 55*a*. Also, the inner rear face 56*i* of the annular free-wheeling bearing cover guide ring 56 includes an annular channel or groove 73 that receives the outer portion of the self-lubricating bearings 55*a* that acts as a bearing rail and spacer member.

Figures 7, 7A, 7B, 7C:
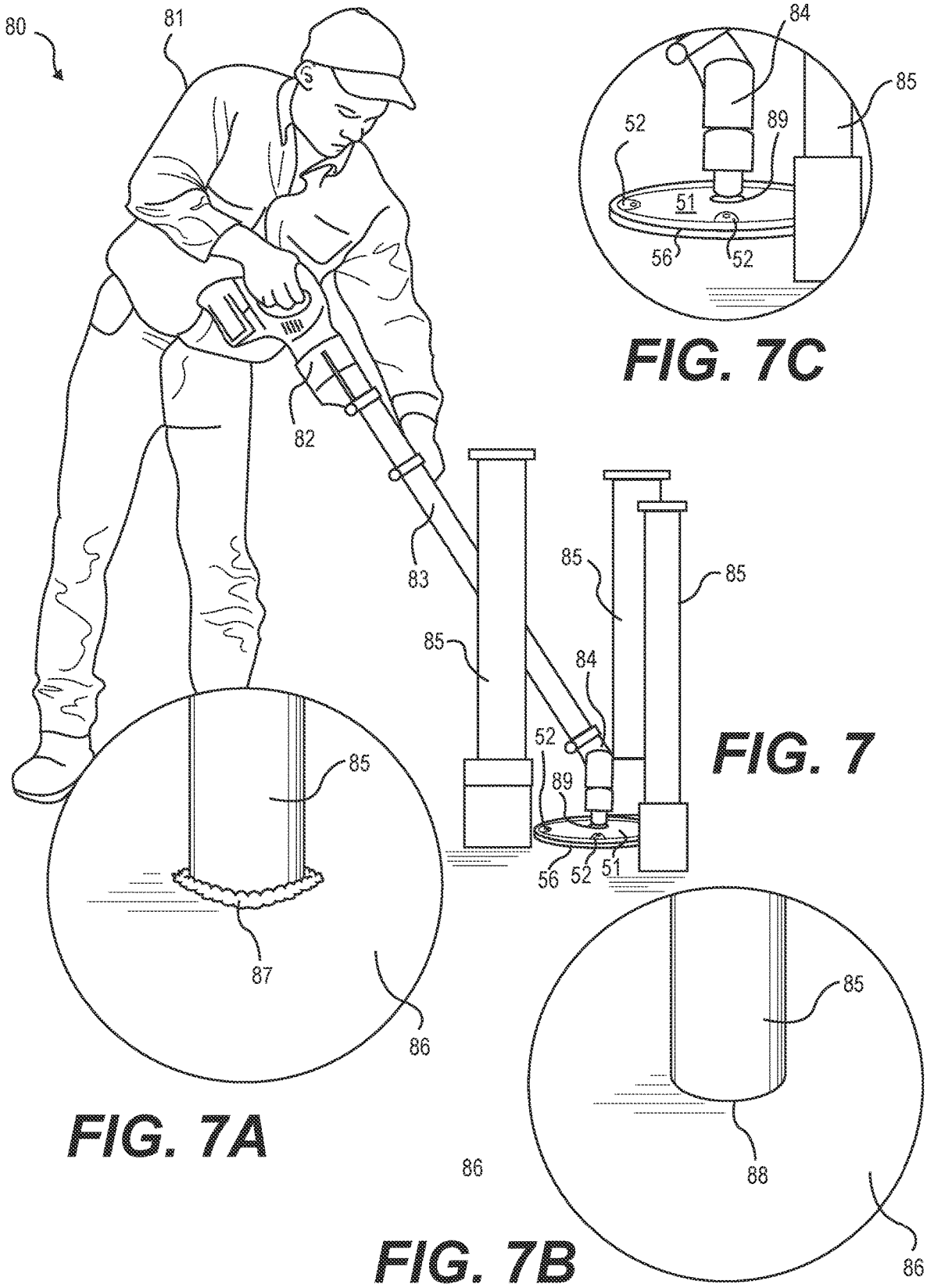
FIG. 7 illustrates a perspective view of a mini-trowel attachment assembly connected to a prime mover for smoothly finishing a concrete or viscous material surface around upstanding obstructions disposed therein, the free-wheeling or free-rotating bearing guide ring assembly is connected to a rotary disk or stabilizer co-operably joined together via a coupling member, and a tool extension connected to the prime mover, which is operated by a user according to the present invention.
FIG. 7A illustrates a cut-out sectional view of an unsmoothed area around an upstanding stub obstruction member disposed within a concrete or viscous material surface according to the present invention.
FIG. 7B illustrates a cut-out sectional view of a smoothed area around an upstanding obstruction member disposed within a concrete or viscous material surface that has been smoothly finished by a rotary stabilizer or disk having replacement finishing blades with a free-wheeling or free-rotating bearing guide ring assembly attached thereto according to the present invention.
FIG. 7C illustrates a cut-out sectional blown-up view of the mini-trowel attachment assembly having a free-wheeling or free-rotating bearing guide ring assembly connected to a prime mover, as shown in FIG. 7 above for smoothly finishing a concrete or viscous material surface around upstanding stub obstructions disposed therein, and the free-wheeling or free-rotating bearing guide ring assembly is directly connected to and disposed around a rotary disk or stabilizer that is co-operably joined by a coupling member and a tool extension according to the present invention.

FIG. 7 illustrates a perspective view of a free-wheeling or free-rotating bearing guide ring assembly 80 connected to a prime mover 82 including an extension member 83 and an adapter 84 that is connected a shaft attachment passage 89 of an annular rotary stabilizer or disk 51 with a plurality of spaced apart non-rotating arm members 52, and each of the plurality of spaced apart non-rotating arm members 52 having an integral connector screw tab 52*d* secured to a rotary disk or stabilizer 51 and an annular free-rotating or free-wheeling bearing cover guide ring member 56 fastened thereto for smoothly finishing a concrete or viscous material surface 86 around upstanding plumbing and/or electrical stub obstructions 85 disposed therein as the free-rotating or free-wheeling bearing guide ring member 56 abuts against the upstanding plumbing or electrical stub obstructions 85 during the concrete or viscous material finishing operation by a user 81. This free-wheeling or free-rotating bearing guide ring assembly 80 eliminates the user 81 from ever using labor intensive hand trowels to smoothly finish the concrete or viscous material surface 86.

FIG. 7A shows a cut-out sectional view of an unsmoothed area 87 shown around an upstanding plumbing or electrical stub obstruction 85 disposed within a concrete or viscous material surface 86. This unsmoothed area 87 will require the use of labor intensive hand trowel devices or other power tools to be used to finish and smooth out the unsmoothed area 87 around the upstanding plumbing or electrical stub obstruction 85.

FIG. 7B shows a cut-out sectional view of a smoothed and finished area 88 around the upstanding plumbing or electrical stub obstruction 85 disposed within the concrete or viscous material surface 86 of FIG. 7A that has been smoothly finished solely by the free-wheeling or free-rotating bearing guide ring assembly 80 of FIG. 7, without ever having to use labor intensive hand trowel devices or other power tools to provide a smooth finish.

FIG. 7C illustrates a larger cut-out sectional view of the free-wheeling bearing guide ring assembly 80 connected to an adapter 84 that is connected to a shaft attachment passage 89 of an annular rotary finishing stabilizer or disk 51 with a plurality of spaced apart non-rotating arm members 52, a plurality of integral connector screw tabs 52*d*, and a screw member assembly 58, 58*a* (for a better view, see FIGS. 5A-5B and 6A-6C) secured to a rotary stabilizer or disk 51 and an annular free-rotating or free-wheeling bearing cover guide ring member 56 fastened thereto for smoothly finishing a concrete or viscous material surface 86 around an upstanding plumbing or electrical stub obstruction 85 disposed therein as the annular free-rotating or free-wheeling bearing guide ring member 56 abuts against the upstanding plumbing or electrical stub obstruction 85 during the concrete or viscous material finishing operation. This free-wheeling or free-rotating bearing guide ring assembly 80 eliminates the user 81 of FIG. 7 from ever using labor intensive hand trowels to smoothly finish the concrete or viscous material surface 86 around the upstanding plumbing or electrical stub obstructions 85 as shown in FIG. 7C.

Figure 8A:
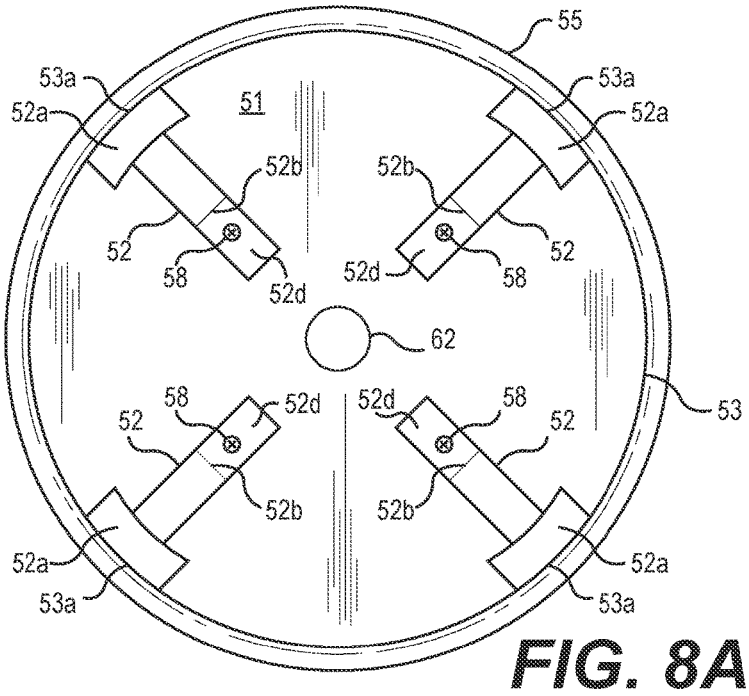
FIG. 8A illustrates a perspective top view of a non-rotary ring with a plurality of spaced apart non-rotating arm members, and each of the plurality of spaced apart non-rotating arm members having an integral connector screw tab secured to a rotary stabilizer or disk according to the present invention.

FIG. 8A illustrates a perspective top view of a free-wheeling or free-rotating bearing guide ring assembly 50 having a first member as a non-rotary ring 53 with a plurality of spaced apart non-rotating arm members 52 with a forward end defining a clip fastening structure 52*a*, and a rear end defining a plurality of integral connector screw tabs 52*d* with a screw opening 52*c* (see FIGS. 5A, 5B, and 6A-6C) disposed therein for securing the plurality of spaced apart non-rotating arm members 52 to a rotary disk or stabilizer 51 via a screw opening 58*a* (see FIGS. 5A, 5B, and 6A-6C) disposed therein by a screw member 58.

Further, the plurality of spaced apart non-rotating arm members 52 are angled upward from a bent point 52*b* at a front end of the integral connector tabs 52*d* to the clip fastening structure 52*a* that is integrally attached to the non-rotating ring 53 at an intermediate location on the rear inner surface 53*b*, 53*b*' of each of the spaced apart non-rotating arm members 52 opposite to element 53*k* which represents the front outer face surface of each of the spaced apart non-rotating arm members 52 of the non-rotating ring 53.

Figure 8B:
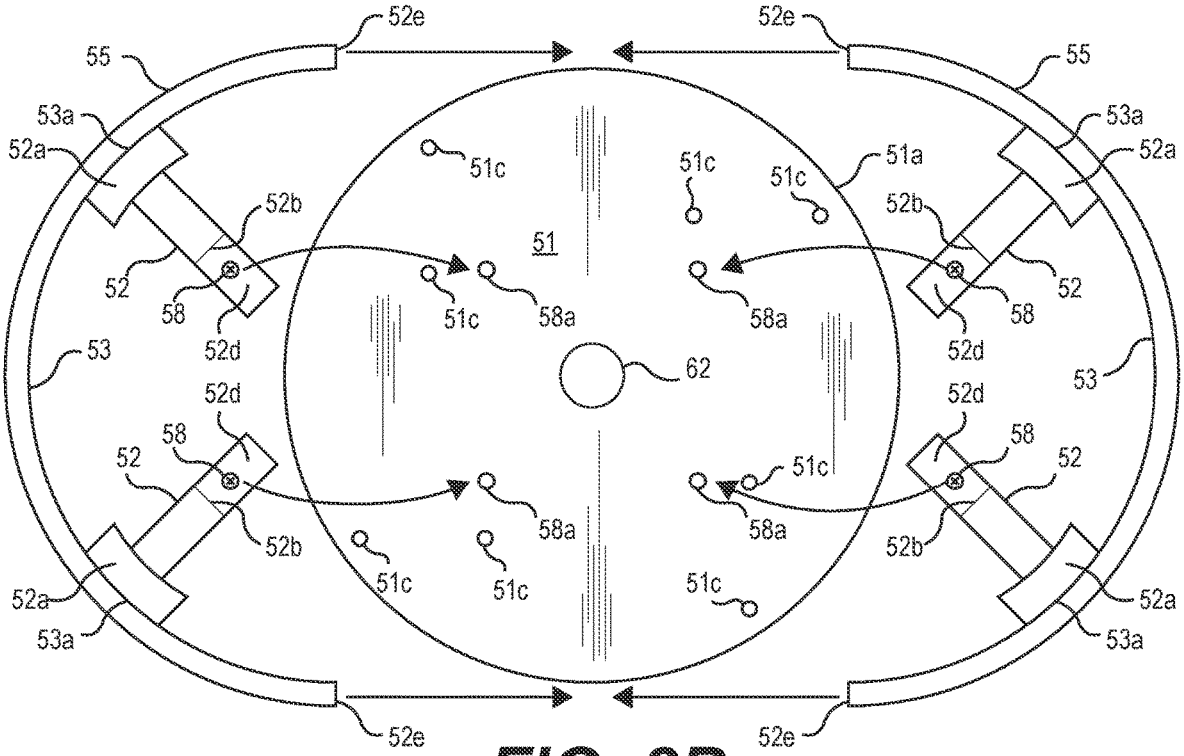
FIG. 8B illustrates a perspective exploded top view of at least a pair of semi-circular free-rotating or free-wheeling bearing cover guide members, a non-rotating ring with a plurality of spaced apart non-rotating arm members, and each of the plurality of spaced apart non-rotating arm members including an integral connector screw tab that is secured to a rotary stabilizer or disk according to the present invention.

FIG. 8B illustrates a perspective exploded top view of FIG. 8A having a free-wheeling bearing guide ring assembly 50 having at least a pair of semi-circular shaped and spaced apart free-rotating or free-wheeling bearing cover guide members 56 that is co-operably fastened to a plurality of spaced apart non-rotating arm members 52 and each of the plurality of spaced apart non-rotating arm members 52 includes an integral connector screw tab 52*d* with a screw opening 52*c* (see FIGS. 5A, 5B, and 6A-6C) disposed therein for securing each of the plurality of spaced apart non-rotating arm members 52 to a rotary stabilizer or disk 51 via a screw opening 58*a* (see FIGS. 5A, 5B, and 6A-6C) disposed therein by a screw member 58. Each of the at least a pair of semi-circular free-wheeling bearing cover guide ring members 56 having a pair of ends 52*e* that abuts one another to form a single a free-wheeling or free-rotating bearing guide ring assembly 50 (see FIGS. 5A-5B). Elements 51*c* represents the screw holes for securing the plurality of spaced apart replacement finishing blades 21*a* of FIG. 5C. Note that any of the plurality of spaced apart replacement finishing blades 21, 21*a*, 36, and 46 as shown in FIGS. 2-4B can use screw holes 51*c*. The screw members 26, 26*a*, 37*a*, and 47*a* (see FIGS. 2-4B, 5C) include a fine pitch thread that extends to a certain position within the screw holes 51*c* to prevent concrete or viscous material from penetrating into the screw holes 51*c* to prevent wear or damage to the fine pitch threads of the screw members 26, 26*a*, 37*a*, and 47*a* that would otherwise cause the plurality of spaced apart replacement blades 21, 21*a*, 36, and 46 to wobble or loosely move, whereby a smooth surface finishing would not be possible.

Note that the non-rotating ring 53, the annular bearing rail and spacer member 55, the annular free-rotating bearing cover guide ring 56 and the ball bearings are preferably made from self-lubricating plastics, such as Teflon. Other self-lubricating material may be selected from other plastics such as Delrin, a non-metal, such as, carbon graphite, metals fabricated with various self-lubricating coatings, one such as molybdenum disulphide (MoS2) with PTFE could be used, if desired.

It is noted that the plurality of spaced apart non-rotating arm members 52 with the integral connector tabs 52*d* and the clip fastening structure 52*a* is formed from varied plastics as a single die-cast plastic molded member integral with the non-rotating ring 53, or this single molded member can be attached to the non-rotating ring 53 by varied bonding types selected from the group consisting of cements, adhesives, glues, welding, or soldering, if desired. Also, each of the plurality of spaced apart non-rotating arm members 52 with the integral connector tabs 52*d* and the clip fastening structure 52*a* integrally attached to the non-rotating ring 53 can be formed by metal stamping selected from the group consisting of aluminum alloys, brass alloys, copper alloys, nickel alloys, steel, and stainless steel, if desired. Further, each of the plurality of spaced apart non-rotating arm members 52 with the integral connector tabs 52*d* and the clip fastening structure 52*a* forms a single member that could be attached to the non-rotating ring 53 by varied mechanical fastening means selected from the group consisting of screw type members, nut and bolt members, rivets, pins, anchors, and other specialized threaded fasteners, such as, captive threaded fasteners, stud threaded inserts, and threaded rods to name just a few. Other types of mechanical fastening means could be utilized, if desired. Note that the plurality of replacement finishing blades 21, 21*a*, 36 and 46 are preferably made from materials selected from the group consisting of varied plastics and metals.

While the foregoing written description of the invention enables one of ordinary skill in the art to make and use what is considered presently to be the best mode thereof, those of ordinary skill will understand and appreciate the existence of variations, combinations, and equivalents of the specific embodiment, method, and examples herein. There, the invention should not be limited by the above described embodiments, and examples, but by all embodiments and methods within the scope and spirit of the invention as claimed.

What is claimed is:

1. A mini-concrete trowel attachment assembly comprising:

a rotary disk, the rotary disk having a top surface, a bottom surface, a plurality of spaced apart screw openings extending through the top and bottom surfaces, and the rotary disk includes an annular peripheral edge;

a plurality of replacement finishing blades, the plurality of replacement finishing blades including a front surface contact portion, a raised flat rear disk attachment portion, an intermediate portion, the intermediate portion is angularly and integrally connected between the raised flat rear disk attachment portion and the front surface contact portion as a single unit, and the front surface contact portion further includes a trailing edge, and an outer bent edge;

each of the raised flat rear disk attachment portions of each of the plurality of replacement finishing blades includes at least a pair of elongated securing slots disposed thereon for aligning with each of the plurality of spaced apart screw openings in the rotary disk to allow for selective blade adjustments of each of the plurality of replacement finishing blades along each of the at least a pair of elongated securing slots;

a plurality of screw members inserted through the at least a pair of the elongated securing slots and through each of the spaced apart screw openings of the rotary disk for securing each of the plurality of replacement finishing blades directly to the rotary disk at selective blade adjustment positions near and inward of the annular peripheral edge of the rotary disk;

each of the at least a pair of the elongated securing slots allows the rotary disk to be interchangeable with rotary disks of varied sizes and securing each of the plurality of replacement finishing blades of varied sizes directly to the rotary disks of varied sizes at selective blade adjustment positions near and inward of an annular peripheral edge of the rotary disks of varied sizes;

a free-wheeling bearing guide ring assembly co-operably associated to and selectively spaced from and above the top surface of the rotary disk and extending slightly beyond the annular peripheral edge of the rotary disk, wherein each of the plurality of replacement finishing blades are selectively adjusted at and inward of the annular peripheral edge of the free-wheeling bearing guide ring assembly via the at least a pair of elongated slots of each of the plurality of replacement finishing blades to smoothly finish a viscous material surface, around stub obstructions disposed in the viscous material surface, and along wall surfaces; and a prime mover being attached to the rotary disk for rotating the rotary disk for smoothing and finishing the viscous material surface by each of the plurality of replacement finishing blades.

2. The mini-concrete trowel attachment assembly according to claim 1, wherein the free-wheeling bearing guide ring assembly includes a first member attached inward of and directly around and adjacent the annular peripheral edge of the rotary disk, the first member is a non-rotating ring member including a first portion having a plurality of spaced apart non-rotating arm members extending angularly up from a bent section to a forward end attached to an intermediate intersecting location on a rear inner face surface thereof, and a second portion having a plurality of connector screw tabs extending from the bent section at a rear end with screw securing holes disposed therein.

3. The mini-concrete trowel attachment assembly according to claim 2, wherein each of the plurality of screw members inserted into each of the screw securing holes of each of the plurality of connector screw tabs that securely attaches the first member directly to and inward of the annular peripheral edge of the rotary disk, and each of the plurality of spaced apart non-rotating arm members being connected to the rotary disk by securing each of the plurality of connector screw tabs thereto by each of the plurality of screw members extending through each of the plurality of spaced apart screw openings, the first member including a pair of first upper and lower fastening clip members, each of the pair of first upper and lower fastening clip members has an upper top radial end portion and an upper bottom radial end portion integrally attached to the first member, each of the pair of the first upper and lower fastening clip members extending radially there from with an outward forward end having a tapered portion, and a fastening cavity is disposed in the upper bottom radial end portion of the first upper fastening clip member below the top radial end portion and in the lower top radial end portion of the first lower fastening clip member above the lower bottom radial end portion of the first lower fastening clip member, wherein the upper top and bottom radial end portions and the lower top and bottom radial end portions, respectively, are disposed above and below where the forward end of each of the plurality of spaced apart non-rotating arm members integrally attaches to the intersecting location of the rear inner face surface.

4. The mini-concrete trowel attachment assembly according to claim 2, wherein a front outer face surface is disposed on each of the plurality of spaced apart non-rotating arm members and including a self-lubricating bearing rail and spacer member disposed along an intermediate portion thereof, and opposite to the forward end of each of the plurality of spaced apart non-rotating arm members that attaches to the intermediate intersecting location of the rear inner face surface thereof.

5. The mini-concrete trowel attachment assembly according to claim 4, wherein a second member includes an annular free-wheeling bearing cover guide ring member having an annular front outer face surface and an annular rear inner face surface, the annular rear inner face surface encloses the front outer face surface and the self-lubricating bearing rail and spacer member of each of the plurality of spaced apart non-rotating arm members, and engaging the self-lubricating bearing and spacer member disposed on each of the plurality of spaced apart non-rotating arm members when the annular free-wheeling bearing cover guide ring member is secured to by fastening over the first upper and lower fastening clip members of each of the plurality of spaced apart non-rotating arm members by upper and lower spaced apart clip members of the annular free-wheeling bearing cover guide ring member, the upper and lower spaced apart clip members of the annular free-wheeling bearing cover guide ring member being attached to and radially extending from the annular free-wheeling bearing cover guide ring member at annular top and bottom outer end portions, and annular top and bottom inner end portions of each of the upper and lower spaced apart clip members, an annular outer end tapered portion connected between the annular top and bottom outer end portions and the annular top and bottom inner end portions of the annular free-wheeling bearing cover guide ring member, and the annular top and bottom outer end portions and the annular top and bottom inner end portions of the annular free-wheeling bearing cover guide ring member having a radially extending end with a latching fastener including a bead member; and, the fastening cavity is disposed in a bottom radial end portion below the top radial end portion and above the bottom radial end portion of the first upper and lower fastening clip members, and the annular outer tapered end of the annular free-wheeling bearing cover guide ring member having an inner tapered end portion that aligns with and spaced from the outer tapered end portion of each of the first upper and lower first fastening clip members at each of the top and bottom radial end portions thereof and creating a clearance space therebetween.

6. The mini-concrete trowel attachment assembly according to claim 5, wherein each of the upper and lower spaced apart fastening clip members being received over the outer tapered portion of the top and bottom radial portions of the first upper and lower fastening clip members with the fastening bead member being received within the fastening cavity disposed below the top radial portion and above the bottom radial portion of the first upper and lower fastening clip members that will causes the annular rear inner face surface of the annular free-wheeling bearing cover guide ring member to engage and move along each of the self-lubricating bearing rail and spacer member of each of the plurality of spaced apart non-rotating arm members when the prime mover rotates the rotary disk with each of the plurality of replacement finishing blades for smoothly finishing a viscous material surface.

7. The mini-concrete trowel attachment assembly according to claim 5, the clearance space formed between the annular tapered rear inner end portion, the annular top inner end portion, and the annular bottom inner end portion of the upper and lower spaced apart fastening clip members of the annular free-wheeling bearing cover guide ring member, the outward tapered rear end portion, the top radial end portion, and the bottom radial end portion of the first upper and lower fastening clip members of each of the plurality of spaced apart non-rotating arm members, the front outer face surface of each of the plurality of spaced apart non-rotating arm members, and the annular rear inner face portion of the annular free-wheeling bearing cover guide ring member when the annular rear inner face of the annular free-wheeling bearing cover guide ring member abuts against the self-lubricating bearing rail and spacer member of each of the plurality of spaced apart non-rotating arm members, wherein the clearance space allows for movement without binding as the fastening bead member moves within the fastening cavity of each of the plurality of spaced apart non-rotating arm members upon the fastening of the annular free-wheeling bearing cover guide ring to each of the plurality of spaced apart non-rotating arm members.

8. The mini-concrete trowel attachment assembly according to claim 2, wherein the first portion of each of the plurality of spaced apart non-rotating arm members having a rear inner face surface and a front outer face surface, each of the plurality of spaced apart non-rotating arm members extending angularly up from a bent section to a forward end that is attached to an intermediate intersecting location at the rear inner face surface thereof, and each of the spaced apart non-rotating arm members including a second portion with at least a connector screw tab extending from a bent section at a rear end thereof with at least a screw securing hole disposed therein; and at least a screw member being disposed through the at least a screw securing hole of each of the at least a connector screw tab for securing each of the plurality of non-rotating arm members directly to the rotary disk and positioned inward of the annular peripheral edge of the rotary disk and spaced there above, each of the plurality of spaced apart non-rotating arm members includes first upper and lower fastening clip members, each of the first upper and lower fastening clip members has an upper top radial end portion and an upper bottom radial end portion integrally attached to the first member, and each of the first upper and lower fastening clip members extending radially therefrom with an outward forward end having a tapered portion, and a fastening cavity is disposed in the upper bottom radial end portion of each of the first upper fastening clip member below the top radial end portion and in the lower top radial end portion of each of the first lower fastening clip member above the lower bottom radial end portion of each of the first lower fastening clip member.

9. The mini-concrete trowel attachment assembly according to claim 8, wherein the front outer face surface of each of the plurality of spaced apart non-rotating arm members includes a self-lubricating bearing rail and spacer member disposed along an intermediate portion thereof, and opposite the forward end of each of the plurality of spaced apart non-rotating arm members that is attached to the rear inner face surface of each of the plurality of spaced apart non-rotating arm members, and a second member includes at least a pair of semi-circular free-wheeling bearing cover guide ring members having a front outer face surface and a rear inner face surface, each of the rear inner face portions of each of the at least a pair of the semi-circular free-wheeling bearing cover guide ring member engages and encloses the front outer face portion and the self-lubricating bearing rail and spacer member of each of the plurality of spaced apart non-rotating arm members when the second member is secured to each of the first upper and lower fastening clip members of the first member by a second pair of upper and lower fastening clip members disposed on the second member.

10. The mini-concrete trowel attachment assembly according to claim 9, wherein each of the second upper and lower fastening clip members of each of the at least a pair of semi-circular free-wheeling bearing cover guide ring members being attached to and radially extending from each of the at least a pair of semi-circular free-wheeling bearing cover guide ring members at semi-circular top and bottom outer end portions, and semi-circular top and bottom inner end portions of each of the upper and lower spaced apart clip members, a semi-circular outer end tapered portion connected between the semi-circular top and bottom outer end portions and the semi-circular top and bottom inner end portions of each of the at least a pair of free-wheeling bearing cover guide ring members, and the semi-circular top and bottom outer end portions and the semi-circular top and bottom inner end portions of each of the at least a pair of semi-circular free-wheeling bearing cover guide ring members having a radially extending latching fastener including a bead member formed thereon;

a fastening cavity is disposed in a bottom radial end portion below the top radial end portion and above the bottom radial end portion of the first upper and lower fastening clip members, and the semi-circular outer tapered end of each of the at least a pair of semi-circular free-wheeling bearing cover guide ring members having an inner tapered end portion that aligns with and spaced from the outer tapered end portion of each of the first upper and lower fastening clip members at each of the top and bottom radial end portions thereof, and having a clearance space formed therebetween; and wherein the second upper and lower spaced apart clip members of each of the at least a pair of semi-circular free-wheeling bearing cover guide ring members being received over the outer tapered portion of the top and bottom radial end portions of each of the first upper and lower fastening clip members with each of the fastening bead members being disposed within each of the fastening cavities disposed below the top radial portion and above the bottom radial portion of each of the first upper and lower fastening clip members for allowing the rear inner face surface of each of the at least a pair of semi-circular free-wheeling bearing cover guide ring members to enclose the front outer face surface and the self-lubricating bearing rail and spacer member of each of the plurality of spaced apart non-rotating arm members to engage and move along each of the self-lubricating bearing rail and spacer members when a prime mover rotates the rotary disk with the plurality of replacement finishing blades for smoothly finishing a viscous material surface.

11. The mini-concrete trowel attachment assembly according to claim 10, wherein the clearance space disposed between the inner tapered portion of each of the at least a pair of semi-circular free-wheeling bearing cover guide ring members aligns with and spaced from the outer tapered end portion of each of the first upper and lower fastening clip members at each of the top and bottom radial end portions thereof when the rear inner face surface of each of the at least a pair of free-wheeling bearing cover guide ring members abuts against each of the-self-lubricating bearing rail and spacer members, whereby this clearance space allows for rotation without binding as each of the fastening bead members moves within and along each of the fastening cavities disposed below the top radial end portion and above the bottom radial end portion of the first upper and lower fastening clip members of the first member.

12. The mini-concrete trowel attachment assembly according to claim 11, wherein each one of the at least a pair of semi-circular free-wheeling bearing cover guide ring members having a pair of ends, each one of the pair of ends abuts against one another when the second upper and lower fastening clip members are received over and fastened to the first upper and lower fastening clip members forming a single annular free-wheeling bearing cover guide ring member, each one of the plurality of spaced apart non-rotating arm members has a self-lubricating bearing rail and spacer member disposed along an intermediate portion thereof, each one of the self-lubricating bearing rail and spacer members includes a bearing channel that receives a plurality of spaced apart self-lubricating ball bearings therein; and the rear inner face surface of the single annular free-wheeling bearing cover guide ring member engages the plurality of spaced apart self-lubricating ball bearings when the single annular free-wheeling bearing cover guide ring member is secured to each of the first-upper and lower fastening clip members of the first member by the second upper and lower fastening clip members of the single annular free-wheeling bearing cover guide ring member to allow the single annular free-wheeling bearing cover guide ring member to rotate along each of the self-lubricating ball bearings in opposite directions during a surface finishing operation.

13. The mini-concrete trowel attachment assembly according to claim 12, wherein the first and second members, the bearing rail and spacer member, and each of the plurality of ball bearings are made from self-lubricating material selected from the group consisting of self-lubricating plastics, metals fabricated with self-lubricating coatings, and a non-metal, and each of the plurality of replacement finishing blades, the non-rotary ring member, each of the plurality of spaced apart non-rotary arm members, and the rotary disk are made from plastics or metals.

14. An improved mini-concrete trowel attachment apparatus connected to a prime mover tool, comprising:

a rotary stabilizer having a top surface and a bottom surface with a plurality of spaced apart screw holes extending there through;

a plurality of replacement blades attached to the bottom surface of the rotary stabilizer;

the plurality of replacement blades including a front contact smoothing portion with an upturned outer peripheral edge, an intermediate portion having one end extending from and connected to a rear end of the front contact portion at an inclined angle, and a rear flat portion having a front end extending from and connected to the other end by the intermediate inclined angle portion defining a unitary member;

each of the rear flat portions of the plurality of replacement blades includes at least a pair of elongated securing slots located at a back end thereof for aligning with the plurality of spaced apart screw holes in the rotary stabilizer;

a plurality of screw members inserted through the at least a pair of elongated securing slots and through the spaced apart screw holes of the rotary stabilizer for adjustably securing each of the plurality of replacement blades directly to the rotary stabilizer at a selective position near and inward of an annular peripheral edge of the rotary stabilizer; and a free-wheeling bearing guide ring assembly being removably attached directly to and positioned near and outward of the annular peripheral edge of the rotary stabilizer, and each of the plurality of replacement blades are adjustable along the at least a pair of elongated slots to secure each of the plurality of replacement blades at a selective position adjacent and inward of an annular peripheral edge of the free-wheeling bearing guide ring assembly by the plurality of screw members.

15. An improved mini-concrete trowel attachment apparatus connected to a prime mover tool according to claim 14, wherein the elongated slots allow for selective adjustment of each of the plurality of replacement blades to align with misaligned manufactured screw holes within the rotary stabilizer with each of the plurality of screw members.

16. An improved mini-concrete trowel attachment apparatus connected to a prime mover tool according to claim 15, wherein each of the screw members include a selective fine pitch thread, each of the screw members extends through the rotary stabilizer to a selective distance at the top surface thereof.

17. An improved mini-concrete trowel attachment apparatus connected to a prime mover tool according to claim 14, wherein the free-wheeling bearing guide ring assembly includes a first non-rotating ring member with a rear inner face surface with a plurality of spaced apart attachment members extending therefrom, a front outer face surface having a self-lubricating bearing and spacer member disposed thereon, a second annular free-wheeling bearing cover guide ring member having a rear inner face surface and a front outer face surface, the plurality of spaced apart attachment members further include a first portion having a plurality of spaced apart non-rotating arm members having a forward end extending from and attached to an intermediate intersecting location on the rear inner face surface of each of the plurality of spaced apart non-rotating arm members, and a rear end of each of the plurality of spaced apart non-rotating arm members having a second portion including a connector screw tab extending therefrom with screw securing holes disposed therein and secured to the rotary stabilizer at a selective position inward of the annular outer peripheral edge thereof by a plurality of attachment screws.

18. An improved mini-concrete trowel attachment apparatus connected to a prime mover tool according to claim 17, wherein each of the plurality of spaced apart non-rotating arm members includes a first upper and lower fastening clip members attached integrally at top and bottom radial end portions thereof, each of the first upper and lower fastening clip members extending radially therefrom with an outward forward end having a tapered portion, and a fastening cavity disposed below the top radial end portion and above the bottom radial end portion of each of the first upper and lower fastening clip members, the self-lubricating bearing and spacer member disposed along an intermediate portion of the front outer face surface of each of the plurality of spaced apart non-rotating arm members, and opposite to the forward end of each of the plurality of non-rotating arm members attached to the intermediate intersecting location at each of the rear inner face surfaces; and wherein the second annular free-wheeling bearing cover guide ring member rear inner face surface engages and moves along the front outer face surface and the self-lubricating bearing and spacer member of each of the plurality of spaced apart non-rotating arm members when the second annular free-wheeling bearing cover guide ring member is secured to the first upper and lower fastening clip members of each of the plurality of spaced apart non-rotating arm members by a second upper and lower spaced apart fastening clip members of the second annular free-wheeling bearing cover guide member.

19. An improved mini-concrete trowel attachment apparatus connected to a prime mover tool according to claim 18, wherein the second upper and lower spaced apart fastening clip members being integrally attached to and radially extending from the second annular free-wheeling bearing cover guide ring member at top and bottom radial end portions thereof, an outward forward end having an outer tapered portion, and a lower portion integrally attached to the outer tapered portion with a radially extending outward end having a locking fastener including a bead member; and wherein the outward forward end of the second upper and lower spaced apart fastening clip members having an inner tapered portion that aligns with and spaced from the outer tapered portion of the first upper and lower fastening clip members and between the top and bottom radial end portions thereof forming a clearance space therebetween when the rear inner face surface of the second annular free-wheeling bearing cover guide ring member engages the self-lubricating bearing and spacer member of each of the plurality of spaced apart non-rotating arm members, whereby the clearance space allows for rotation without binding as the fastening bead member moves within the fastening cavity of each of the plurality of spaced apart non-rotating arm members.

20. An improved mini-concrete trowel apparatus connected to a mover tool according to claim 19, each of the self-lubricating bearing and spacer member includes a front outer face surface having a plurality of spaced apart bearing holes disposed therein, a plurality of self-lubricating ball bearings disposed within each of the plurality of spaced apart bearing holes with a portion extending outward thereof, and allowing for rotational movement therein; and the rear inner face surface of the second annular free-wheeling bearing cover guide ring member includes an annular channel along an intermediate portion thereof that engages and receives each of the plurality of self-lubricating ball bearings that extends from each of the plurality of spaced apart bearing holes in the front outer face surface of the annular self-lubricating bearing and spacer member when the second annular free-wheeling bearing cover guide ring member is secured to the first upper and lower fastening clip members of each of the plurality of spaced apart non-rotating arm members by the second a plurality of upper and lower spaced apart fastening clip members of the second annular free-wheeling bearing cover guide ring member, and allows the second annular free-wheeling bearing cover guide ring member to move in opposite directions when abutting against wall structures and upstanding stub obstructions disposed within a concrete surface.

21. An improved mini-concrete trowel attachment apparatus connected to a prime mover tool according to claim 20, wherein the second annular free-wheeling bearing cover guide ring member includes at least a pair of separate semi-circular free-wheeling bearing cover guide ring members having a pair of ends disposed thereon, at least a pair of separate and spaced apart non-rotating ring members having a rear inner face surface and a front outer face surface, the rear inner face surface of each of the at least a pair of separate and spaced apart non-rotating ring members includes a first portion having a plurality of spaced apart non-rotating arm members extending angularly up from a bent section thereon to a forward end and being attached to an intermediate intersecting location on the rear inner face surface of each of the at least a pair of separate and spaced apart non-rotating ring members, and a second portion of the plurality of spaced apart non-rotating arm members having a rear end having a plurality of connector screw tabs extending from the bent section with screw securing holes disposed therein, a plurality of screw members inserted into the screw securing holes of each of the plurality of connector screw tabs for securing each of the spaced apart non-rotating arm members directly to and inward of the annular outer peripheral edge of the rotary stabilizer, each of the plurality of spaced apart non-rotating arm members includes a first upper and lower fastening members disposed thereon, and the at least a pair of separate semi-circular free-wheeling bearing cover guide ring members includes a second upper and lower spaced apart fastening members disposed thereon, such that upon the securing of each of the plurality of spaced apart non-rotating arm members to the at least a pair of separate semi-circular free-wheeling bearing cover guide ring members when the second upper and lower spaced apart fastening clip members are fastened to and received over the first upper and lower fastening clip members, and the pair of ends of each of the at least a pair of separate semi-circular free-wheeling bearing cover guide ring members abuts against one another to form an unitary and annular free-wheeling bearing cover guide ring member.

22. An improved mini-concrete trowel attachment apparatus connected to a prime mover tool according to claim 21, wherein the second upper and lower spaced apart fastening members of the unitary and annular free-wheeling cover guide ring member attaches to each of the first upper and lower fastening clip members at top and bottom radial end portions thereof, and extending radially therefrom with the outward forward end and the tapered outer portion, and a fastening surface being disposed below the top radial end portion and above the bottom radial end portion of each of the first upper and lower fastening clip members, wherein each of the second upper and lower spaced apart fastening clip members received over the outer tapered portion of the top and bottom radial portions of each of the first upper and lower fastening clip members with the fastening bead member abuts and move along the fastening surface disposed below the top radial portion and above the bottom radial portion of each of the first upper and lower fastening clip members that causes the annular rear inner face surface of the unitary and annular free-wheeling bearing cover guide ring member to engage and move along each of the self-lubricating bearing rail and spacer member of each of the plurality of spaced apart non-rotating arm members when the prime mover rotates the rotary stabilizer with the plurality of replacement blades for smoothly finishing a viscous material surface; and the front outer face surface of each of the plurality of spaced apart non-rotating arm members having a self-lubricating bearing and spacer member that engages the second unitary and annular free-wheeling bearing cover guide ring member to allow the unitary and annular free-wheeling bearing cover guide ring member to rotate along the self-lubricating bearing and spacer member of each of the plurality of spaced apart non-rotating arm members when the first upper and lower fastening clip members of each of the at least a pair of the spaced apart non-rotary arm members, and the second upper and lower spaced apart fastening clip members of the unitary and annular free-wheeling bearing cover guide ring member are fastened together.

23. An improved mini-concrete trowel attachment apparatus connected to a prime mover tool according to claim 22, wherein each of the at least a pair of separate and spaced apart non-rotating ring members, each of the plurality of spaced apart non-rotating arm members, each of the plurality of connector tabs, each of the plurality of screw members, each of the plurality of replacement blades, and the rotary stabilizer are made from plastics or metals, each of the bearing rail and spacer members, each of the at least a pair of separate and spaced apart non-rotating ring members, the first upper lower fastening clip members of each of the at least a pair of separate and spaced apart non-rotating ring members, the second upper and lower spaced apart fastening clip members of the unitary and annular free-wheeling bearing cover guide ring member, the unitary and annular free-wheeling bearing cover guide ring member, and the plurality of ball bearings are made from self-lubricating material selected from the group consisting of self-lubricating plastics, metals fabricated with self-lubricating coatings, and a non-metal.

24. An improved concrete trowel device attached to a hand-operated power tool, the improved concrete trowel device comprising:

a rotary disk having a top surface and a bottom surface with a plurality of spaced apart screw holes extending there through;

a plurality of flexible replacement blades attached to the bottom surface of the rotary disk;

each of the plurality of flexible replacement blades including a front contact smoothing portion with an upturned outer peripheral edge, an intermediate portion extending therefrom and connecting to a rear end of the front contact smoothing portion at an inclined angle, and a rear flat portion having a rear end and extending therefrom and connecting to the intermediate inclined angle portion forming a unitary member;

each of the rear flat portions of the plurality of flexible replacement blades includes at least a pair of elongated securing slots located at a back end thereof for aligning with each of the plurality of spaced apart screw holes in the rotary disk;

a plurality of screw members inserted through each of the at least a pair of elongated securing slots and through each of the spaced apart screw holes of the rotary disk for adjustably securing each of the plurality of flexible replacement blades directly to the rotary disk at a selective position near and inward of an outer peripheral edge of the rotary disk, each of the at least a pair of elongated securing slots of each of the plurality of flexible replacement blades allows each of the plurality of flexible replacement blades to be adjusted near and inward of the outer peripheral edge of the rotary disk to adjustably align with any misaligned manufactured spaced apart screw holes in the rotary disk; and a free-rotating bearing guide ring assembly being cooperably attached to and inward of the outer peripheral edge of the rotary disk, and each of the plurality of flexible replacement blades are adjustable along each of the at least a pair of elongated slots to secure each of the plurality of flexible replacement blades at a selective position at and adjacent to the outer peripheral edge of the rotary disk by each of the plurality of screw members so that each of the plurality of flexible replacement blades are able to finish closely to wall structures and around electrical and plumbing stub obstructions that extend through concrete surfaces, wherein each of the plurality of flexible replacement blades are made from plastics or metals.

25. An improved mini-concrete trowel attachment apparatus connected to a prime mover tool according to claim 24, wherein the free-rotating bearing guide ring assembly includes at least a pair of non-rotary ring members having a first portion including a plurality of separate and spaced apart non-rotating arm members, each of the plurality of separate and spaced apart non-rotating arm members having a rear inner face surface and a front outer face surface at a forward end thereof, each of the plurality of separate and spaced apart non-rotating arm members extending angularly up from a bent section thereon to the forward end and attached to an intermediate intersecting location on the rear inner face surface of each of the plurality of separate and spaced apart non-rotating arm members, and wherein each of the plurality of separate and spaced apart non-rotating arm members including a rear end having a plurality of connector screw tabs extending from the bent section with screw securing holes disposed therein, a plurality of screw members inserted into each of the screw securing holes of each of the plurality of connector screw tabs for securing each of the plurality of separate and spaced apart non-rotating arm members to and inward of the annular outer peripheral edge of the rotary disk, the front outer face surface of each of the plurality of separate and spaced apart non-rotating arm members includes an annular self-lubricating bearing rail and spacer member, each of the plurality of separate and spaced apart non-rotating arm members having first upper and lower clip fastener members disposed thereon, and the free-rotating bearing guide assembly further includes an annular free-rotating bearing cover guide ring member having second upper and lower clip fastening members disposed thereon.

26. An improved mini-concrete trowel attachment apparatus connected to a prime mover tool according to claim 25, wherein the self-lubricating bearing rail and spacer member of each of the plurality of separate and spaced apart non-rotating arm members having an annular rear inner face portion and an annular front outer face portion, the annular rear inner face portion of the second annular free-wheeling bearing cover guide ring member abuts against and encloses each of the self-lubricating bearing rail and spacer member, and enclosing the front outer face surface of each of the plurality of spaced apart non-rotating arm members, upon fastening each of the first upper and lower fastening clip members of each of the plurality of separate and spaced apart non-rotating arm members to the second upper and lower second fastening clip members of the annular free-rotating bearing cover guide ring member thereto to allow the annular free-rotating bearing cover guide ring member to rotate in different directions when the annular free-rotating bearing cover guide ring member moves against and away from the wall structures and around the electrical and plumbing stub obstructions during concrete surface finishing by each of the plurality of flexible replacement blades, upon rotation of the rotary disk by the prime mover hand-operated power tool.

* * * * *